US006947692B2

(12) United States Patent
Kondo et al.

(10) Patent No.: US 6,947,692 B2
(45) Date of Patent: Sep. 20, 2005

(54) IMAGE FORMING METHOD AND APPARATUS

(75) Inventors: Maiko Kondo, Numazu (JP); Fumihiro Sasaki, Fuji (JP); Toshiki Nanya, Mishima (JP); Shinichiro Yagi, Numazu (JP); Masami Tomita, Numazu (JP); Shigeru Emoto, Numazu (JP); Naohito Shimota, Suntoh-gun (JP); Hiroto Higuchi, Numazu (JP); Tomoyuki Ichikawa, Numazu (JP)

(73) Assignee: Ricoh Company Limited, Tokyo (JP)

( * ) Notice: Subject to any disclaimer, the term of this patent is extended or adjusted under 35 U.S.C. 154(b) by 121 days.

(21) Appl. No.: 10/666,254

(22) Filed: Sep. 22, 2003

(65) Prior Publication Data

US 2004/0126147 A1 Jul. 1, 2004

(30) Foreign Application Priority Data

Sep. 20, 2002 (JP) ..... 2002-275550

(51) Int. Cl.[7] ..... G03G 15/09
(52) U.S. Cl. ..... 399/277; 399/276
(58) Field of Search ..... 399/111, 252, 399/265, 267, 276, 277

(56) References Cited

U.S. PATENT DOCUMENTS 6,593,048 B2 7/2003 Sasaki et al.
6,597,883 B2 7/2003 Muramatsu et al.
6,653,037 B2 11/2003 Sawada et al.
6,660,443 B2 12/2003 Sugiyama et al.
6,667,141 B2 12/2003 Iwamoto et al.
6,778,805 B2 * 8/2004 Kai et al. ..... 399/346
6,792,234 B2 * 9/2004 Ikeguchi et al. ..... 399/267

FOREIGN PATENT DOCUMENTS

| | | |
|---|---|---|
| JP | 2001-10336 | 1/2000 |
| JP | 2000-305360 | 11/2000 |
| JP | 2000-347506 | 12/2000 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A method for developing an electrostatic latent image, including forming a magnet brush of a developer including a toner and a carrier on a developing sleeve including a main magnet and auxiliary magnets; and developing the electrostatic latent image with the magnet brush to form a toner image at a rubbing region, wherein the magnetic flux density in a normal line direction, half width, and attenuation ratio of the main magnet and the angle between the main magnet and auxiliary magnets are specified, and the magnetic sleeve has specific grooves thereon, and wherein the toner has a volume average particle diameter of from 4.0 to 7.0 μm, and includes fine particles having a circle equivalent diameter not greater than 2 μm in an amount not greater than 20% by number.

18 Claims, 7 Drawing Sheets

IMAGE FORMING METHOD AND APPARATUS

BACKGROUND OF THE INVENTION

1. Field of the Invention

The present invention relates to an image forming method and an image forming apparatus. Specifically, the present invention relates to a method for developing an electrostatic latent image with a developer, and to a developing apparatus including magnetic poles for forming a magnetic brush of a developer in a developing region on a surface of a developer bearing member. In addition, the present invention also relates to a process cartridge which produces images using a toner, and a method for fixing a toner image.

2. Discussion of the Background

Copiers, printers, facsimile apparatus and similar electrophotographic or electrostatic image forming apparatus generally include a latent image bearing member such as photoconductive drums or photoconductive belts. A latent image is formed on the image bearing member in accordance with image data. It is popular to use a magnet brush developing method using a two-component developer made of a toner and a carrier from the view point of image transferability, halftone reproducibility and temperature/humidity stability of developing characteristics. In such a developing method, the two-component developer forms brush chains on a developer bearing member and is fed to a developing region where the developer bearing member faces the image bearing member. At the developing region, the toner in the developer adheres to an electrostatic latent image portion formed on the latent image bearing member.

The above-mentioned developer bearing member usually includes a cylindrical sleeve and a magnet roller located in the sleeve for forming a magnetic field by which a developer forms a magnet brush on the surface of the sleeve.

By rotating at least one of the above-mentioned sleeve and magnet roller, erected chains of the developer are moved on the surface of the sleeve. The developer conveyed to the developing region is erected along lines of the magnetic force caused by a main development magnetic pole. The brush chains contact the surface of the latent image bearing member while yielding, and the brush chains rub the latent image because of moving at a linear velocity different from that of the latent image bearing member. At this time, the developer provides the toner for the latent image, resulting in development of the latent image.

Published unexamined Japanese Patent Applications Nos. 2000-305360 and 2000-347506 have proposed image forming technologies to improve image quality of both a high density image portion and a low density image portion at the same time. It is disclosed therein a developing apparatus which visualizes an electrostatic latent image on an image bearing member and which includes a developing sleeve including a nonmagnetic sleeve, and a magnet roller fixedly set within the nonmagnetic sleeve and including plural magnets arranged at a regular angle, wherein the developing sleeve magnetically bears a magnetic two-component developer including a toner and a carrier to form a magnet brush thereon, and wherein the developing sleeve rubs the image bearing member with the magnet brush to visualize the electrostatic latent image at a rubbing region. In this developing apparatus, the attenuation ratio of a magnetic flux density at the rubbing region in a normal line direction is specified. In addition, the attenuation ratio of magnetic flux densities of a main magnet and a magnet adjacent thereto at the rubbing region in a normal line direction, or an angle between the main magnet and the magnet adjacent to the main magnet at the rubbing region are specified.

However, in such a high-efficiency developing method in which a magnetic force of a main development magnetic pole is high, and a developer having a short length of magnet brush rubs a surface of a photoreceptor at a rotating speed of from 1.1 to 3.0 times that of the photoreceptor, the toner is insufficiently supplied i.e., the resultant images have a low image density or the resultant images are unclear when the rotating speed is less than 1.5 times. Therefore the rotating speed ratio is preferably not less than 1.5 times. In this case, a rear-end omission problem in that the rear end of a solid image is omitted occurs. Such a problem tends to be caused under a condition in which the rotating speed ratio is greater than 1.0. This problem is seriously caused as the rotating speed of the magnetic brush increases.

In order to prevent the rear-end omission problem of toner in such a developing process, i.e., in order to obtain satisfactory image density and image qualities, it is necessary to improve developing ability by another method.

Currently, a toner having a smaller particle size is desired to produce high quality images.

When the particle size of a toner is miniaturized, the content of fine particles in the toner increases. It is confirmed by experiment that a toner having a small particle diameter remarkably contaminates a developing sleeve. The mechanism of this phenomenon is as follows. Toner particles present on a portion of a developing sleeve corresponding to a non-image portion of a photoreceptor is pushed toward the developing sleeve by an electric field. Normally, the toner particles are quickly re-adhered to a surface of the carrier due to electrostatic attraction. However, since fine toner particles have extremely bad fluidity (characteristic specific to a fine powder), the fine toner particles adhered to the, developing sleeve are hardly re-adhered to the carrier surface. Namely, adhesion strength of find toner particles against the developing sleeve is extremely strong. Furthermore, when the fine toner particles adhered to the developing sleeve are rubbed with the carrier many times, fusion-bonding of the toner to the sleeve occurs (hereinafter this phenomenon is referred to as on-sleeve toner fixation). When this on-sleeve toner fixation occurs, the image density decreases with time. In particular, when a solid image is printed continuously on four sheets of paper after a 100,000-copy running test, it is found that the image density of the solid image gradually decreases from the first sheet to the fourth sheet. Namely, since an electrically insulating layer constituted of a toner ingredient is formed on a surface of an electroconductive sleeve, the effective bias of the developing bias applied lowers, and thereby the developing ability of the developing sleeve is deteriorated.

Published unexamined Japanese Patent Application No. 2000-10336 proposes that a developing sleeve is subjected to a blast treatment with spherical particles to form smooth unevenness portion thereon in order to prevent adhesion of a toner to a developing sleeve. The adhesion of a toner to a sleeve can be prevented to some extent by this method, but the ability of the sleeve to feed a developer is not enough for current fast printing machines, and high quality images cannot be obtained easily.

On the other hand, a wax is conventionally included in a toner in order to impart a releasing property to the toner at fixation.

Since waxes have a smaller molecular weight and is softer than a binder resin, so-called a filming phenomenon in that the waxes adhere to a carrier and a photoreceptor and thereby a wax film is formed thereon tends to occur. When the filming phenomenon occurs on the carrier (i.e., a spent carrier problem), the toner cannot be friction-charged with such a carrier. As a result, defective charging occurs and the resultant images have background fouling. In addition, a white stripe abnormal image appears on a halftone image when a wax film is formed on a photoreceptor. In addition, waxes tend to cause the on-sleeve toner fixation. These phenomena turn worse, i.e., it is difficult to maintain the initial image qualities, when copying processes are repeated.

In addition, it is known that temperature increases in a developing apparatus with repetition of copying processes, resulting in increase of the atmospheric temperature at a nip region. The heat is easy to stay in the above-mentioned developer, which has a high density of brush chains, i.e., the heat tends to hardly leak from the developing region. As a result, the wax in the toner easily bleeds out, resulting in occurrence of fixation of the wax on the sleeve, and filming of the wax on the photoreceptor and the carrier used.

Because of these reasons, a need exists for an image forming method by which high quality images are stably produced for a long period of time.

SUMMARY OF THE INVENTION

Accordingly, an object of the present invention is to provide an image forming method and apparatus by which high quality images are produced for a long period of time without causing the rear-end omission problem.

To achieve such a object, the present invention provides an image forming apparatus including an image bearing member bearing an electrostatic latent image thereon; a developing sleeve including a nonmagnetic sleeve; and a magnet roller fixedly arranged within the nonmagnetic sleeve and including plural magnets.

The developing sleeve magnetically bears a magnetic two-component developer including a toner and a carrier to form a magnet brush thereon. The developing sleeve rubs the image bearing member with the magnet brush to visualize the electrostatic latent image at a rubbing region. The magnet roller has a main magnet pole including a main magnet and auxiliary magnets adjacent to the main magnet, which are positioned so as to face the latent image bearing member.

The main magnet has a magnetic flux density of from 100 to 200 mT at the rubbing region in a normal line direction, and a half width of the magnetic flux density not greater than 25°. The auxiliary magnet has an attenuation ratio of a magnetic flux density in a normal line direction not less than 40%, while the magnets are arranged at an angle not greater than 35°. The nonmagnetic sleeve has grooves on an outer surface thereof which is formed in a longitudinal direction thereof at an interval of from 0.4 to 0.6 mm with a depth of from 0.1 to 0.2 mm.

The toner has a volume average particle diameter of from 4.0 to 7.0 $\mu$m, and includes fine powders having a circle equivalent diameter not greater than 2 $\mu$m in an amount not greater than 20% by number.

The toner preferably includes at least a wax and a binder resin. When a cross section of the toner is observed with a transmission electron microscope, a surface portion of the toner, which portion has a depth of from 0 to 1 $\mu$m has a wax area of from 5 to 30%.

The wax preferably exists in the outer portion of toner particles, which outer portion is defined as an outer portion of toner particles having a depth from 0 to half the radius of the toner particles, in an amount not less than 65% by number of the wax dispersed in the entire toner particles.

It is preferable that the wax dispersed in the toner does not appear on a surface of the toner.

It is preferable that particles of the wax having a dispersion diameter of from 0.5 to 3 $\mu$m are dispersed in the toner in an amount not less than 70% by number based on total particles in the toner.

The wax is preferably selected from carnauba waxes subjected to a treatment of removing a free aliphatic fatty acid, rice waxes, montan waxes and combinations thereof.

As another aspect of the present invention, a method for developing an electrostatic latent image is provided, which includes forming a magnet brush of a magnetic developer including a toner and a carrier on the developing sleeve mentioned above and rubbing a surface of an image bearing member bearing the electrostatic latent image thereon with a magnet brush to form a toner image on the image bearing member.

As yet another aspect of the present invention, a process cartridge for an image forming apparatus is provided which includes:

at least an image bearing member configured to bear an electrostatic latent image thereon; and a developing device configured to develop the electrostatic latent image using a developer including the toner mentioned above and the developing sleeve mentioned above to form a toner image on the image bearing member.

The process cartridge may include a charger configured to charge the image bearing member; a cleaner configured to clean a surface of the image bearing member; and other devices for use in the image forming apparatus of the present invention.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The image forming method and apparatus of the present invention will be explained in detail referring to drawings.

Figure 1:
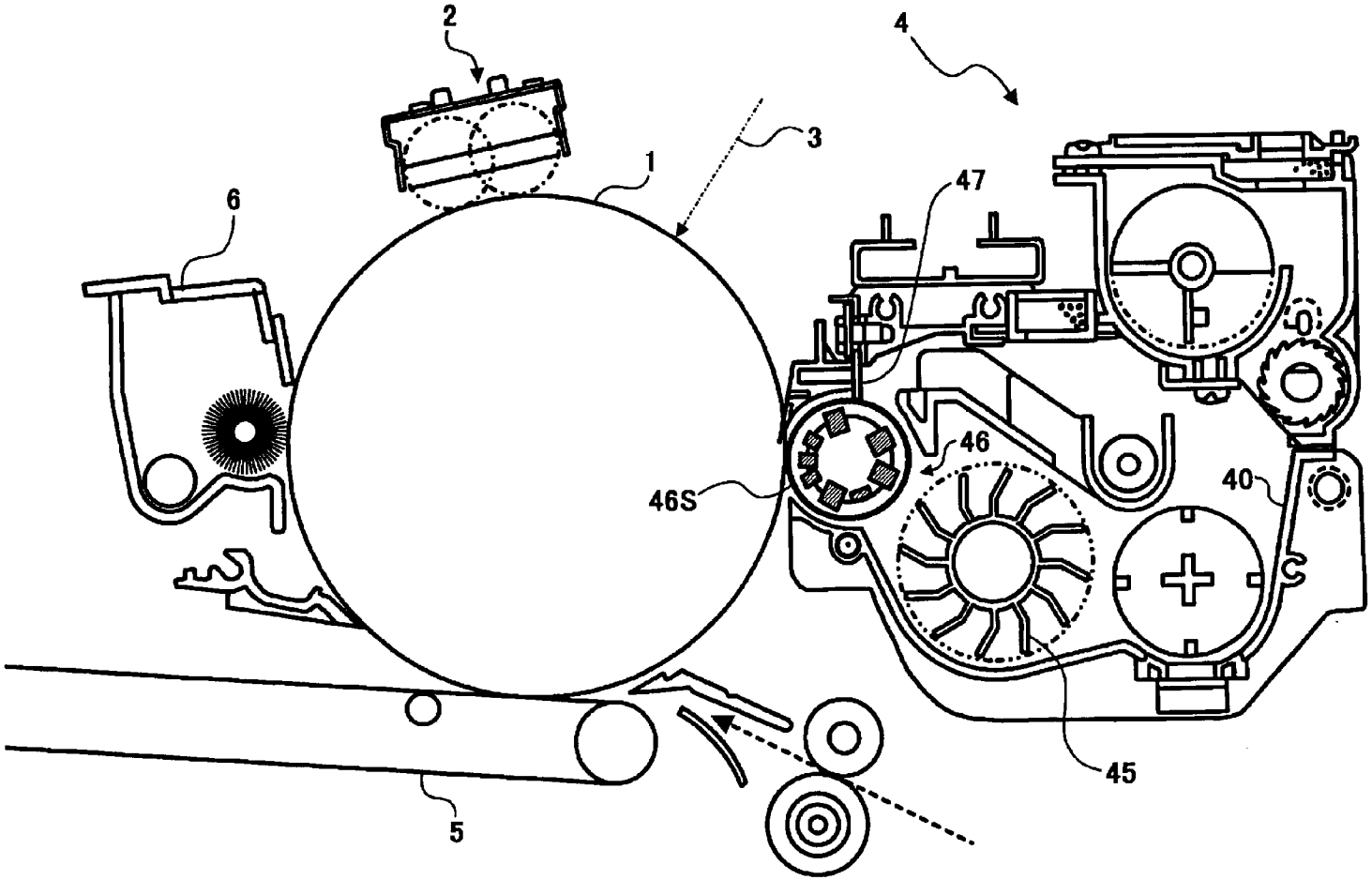
FIG. 1 is a schematic diagram illustrating an example of the image forming apparatus of the present invention.

As illustrated in FIG. 1, the image forming apparatus includes a photoreceptor A serving as an electrostatic latent image bearing member, a charger 2 configured to charge a surface of the photoreceptor A, a laser beam 3 configured to form a latent image on the uniformly charged surface of the photoreceptor A, a developing device 4 configured to form a toner image by developing the latent image on the photoreceptor with a developer including a toner, a transferer 5 configured to transfer the toner image formed on the photoreceptor to a recording paper and a cleaner configured to remove residual toner particles on the photoreceptor.

In such a constitution, the photoreceptor 1, the surface of which is uniformly charged by the charger 2, forms an electrostatic latent image by being exposed to the laser beam 3. The latent image is developed with the developing apparatus 4, and thereby a toner image is formed on the photoreceptor 1. The toner image is transferred from the surface of the photoreceptor 1 to the recording paper, which is fed from a sheet feeding tray (not shown), by the transferer 5 including a transfer belt or the like. The recording paper electrostatically adhered to the photoreceptor during the image transfer process is separated from the photoreceptor by a separation pick. Then the unfixed toner image on the recording paper is fixed to the recording paper by a fixer (not shown). On the other hand, the residual toner on the photoreceptor 1 is removed therefrom by a cleaner 6 and the toner is collected. Thus the photoreceptor 1 is initialized to be used for the next image forming process.

In the developing device 4, a developing roller 46 serving as a developer bearing member is provided close to the photoreceptor 1 and a developing region is formed at a position at which the developing roller 46 and the photoreceptor A are opposed to each other. The developing roller 46 includes a cylindrical sleeve 46*s* which is formed of a nonmagnetic material such as aluminum, brass, stainless and electroconductive resins and which is rotated in a counterclockwise direction by a rotating drive system (not shown). In this example, the inner diameter of the drum of the photoreceptor 1 is 100 mm and the linear velocity of the drum is set to 330 mm/second. The inner diameter of the cylindrical sleeve 46*s* is 25 mm and the linear velocity of the sleeve is set to 660 mm/second. Therefore, the ratio of the linear velocity of the photoreceptor drum to the linear velocity of the cylindrical sleeve is 2.0. In addition, the developing gap, i.e., a gap between the photoreceptor 1 and the developing sleeve 46*s*, is set to 0.5 mm.

Normally, the surface of the developing sleeve 46*s* is subjected to a surface roughening treatment so as to have grooves having a width of 0.2 mm in the longitudinal direction thereof at an interval of from 0.7 mm to 1.0 mm. In the present invention, the interval of the grooves is set to be from 0.4 mm to 0.6 mm to increase the surface area of the sleeve, resulting in increase of density of the brush chain.

A doctor blade 47 is positioned on an upstream side of the developing region relative to the developer feeding direction (i.e., a counterclockwise direction in FIG. 1). The doctor blade 47 controls the height of the brush chains, i.e., the amount of the developer on the developing sleeve. In this example, the gap between the doctor blade 47 and the developing sleeve 46*s* is set to 0.48 mm. Further, a screw 45 is provided at a location opposite to the photoreceptor 1 relative to the developing roller 46 to transport the developer in the developing casing 40 to the developing roller 46 while agitating the developer.

Then the configuration of the magnet roller in the developing roller 46 will be explained. The magnet roller forming a magnetic field is fixedly arranged in the sleeve such that the developer rises on the developing sleeve 46*s* in the form of chains. The carrier in the developer is raised on the developing sleeve 46*s* along the magnetic lines in normal direction in the form of chains. Charged toner particles are adhered to the carrier chains, thereby forming a magnetic brush. The developing sleeve 46*s* conveys the magnetic brush counterclockwise, i.e., in the rotation direction of the sleeve 46*s*.

Figure 4:
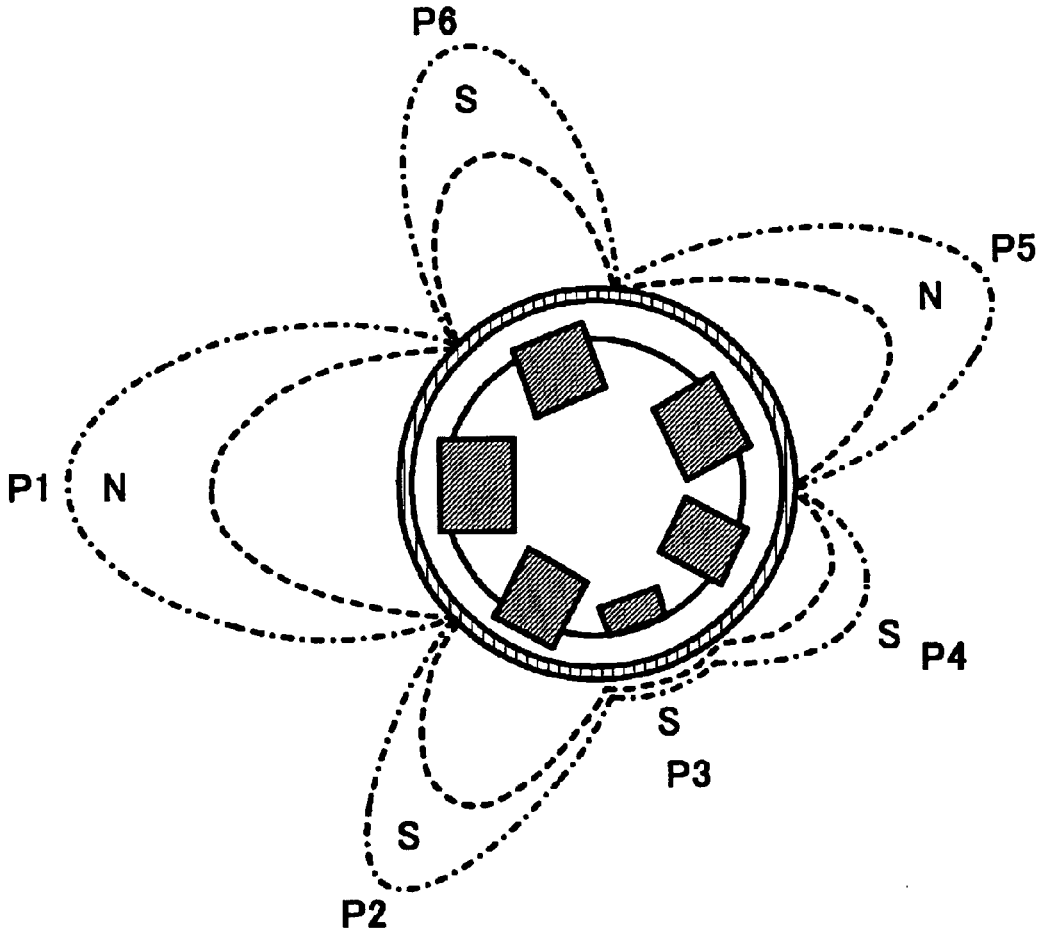
FIG. 4 BACKGROUND ART
FIG. 4 is a schematic diagram illustrating the constitution and the magnetic flux density of a conventional developing sleeve.

FIG. 4 is a schematic view illustrating a conventional developing sleeve including only one magnet as a main magnet pole.

In FIG. 4, a main development magnetic pole P1 is a north pole which forms a magnetic brush for developing an electrostatic latent image. The developing roller further includes magnets P2, P3, P4, P5 and P6.

Figure 2:
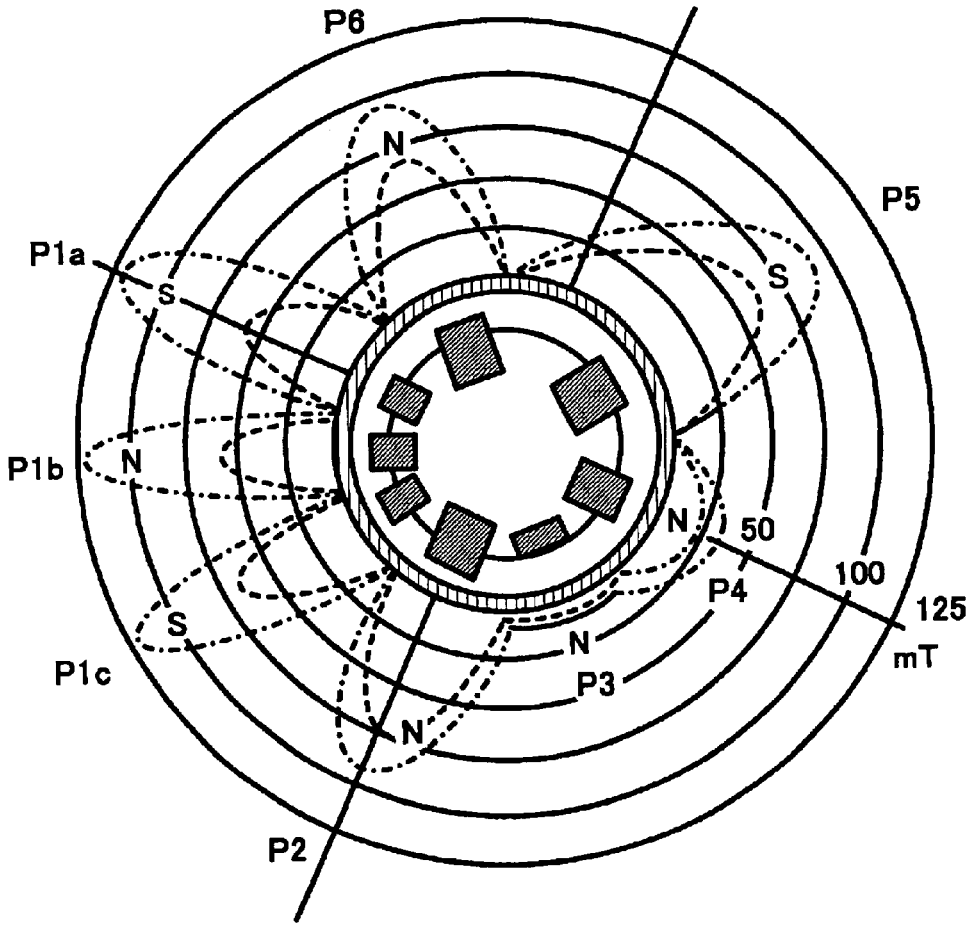
FIG. 2 is a schematic diagram for explaining the magnetic flux density of a developing sleeve for use in the image forming apparatus of the present invention.

In contrast, as illustrated in FIG. 2, the magnet roller of the present invention has a plurality of magnets, P1*a*, P1*b* and P1*c*, as the main development magnetic pole. The magnets P1*a*, P1*b* and P1*c* are positioned so as to face the latent image bearing member, i.e., the magnets are located in a region in which the latent image bearing member is rubbed with the magnet brush.

As illustrated in FIG. 2, the main development magnetic pole P1 includes three magnets, P1*a*, P1*b* and P1*c* each of which has a small cross-section area, are arranged in this order in the developer feeding direction. The magnet P1*b* is the main. magnet and the magnets P1*a* and P1*c* are auxiliary magnets. These magnets are formed of a rare earth metal alloy.

Then the magnetic properties of the developing roller will be explained in detail. The magnetic flux density at the surface of the developing sleeve in the normal direction is shown in dashed lines in FIGS. 2 and 3. A gauss meter HGM-8300 and an axial probe TYPE A1 both manufactured by ADS Co., Ltd. are used for measuring the magnetic flux densities in the normal direction and the magnetic flux densities are recorded in a circle chart.

The attenuation rate is defined as a ratio of a peak value of the magnetic flux density in the normal line direction at a point distanced from the surface of the developing sleeve by 1 mm to the peak value of the magnetic flux density in the normal direction at the surface of the developing sleeve (in units of %) The magnetic flux density at the point distanced from the surface of the developing sleeve by 1 mm is indicated in dotted lines in FIGS. 2 and 4.

Then the half value central angle will be explained referring to FIG. 3. The half value central angle of the magnet P1*a* is defined as an angle formed by a line L1 (i.e., the maximum magnetic force line) and a line L2 passing through a point having a half magnetic force of the maximum magnetic force. If the maximum magnetic force of the magnet is 120 mT, the half value is 60 mT.

In this example, the main magnet P1*b*, a magnet P4 for drawing the developer onto the developing sleeve 46, a magnet P6 feeding the drawn developer to a developing region and magnets P2 and P3 feeding the developer in a region after the developing region form N poles. The auxiliary magnets P1*a* and P1*c* and a magnet P5 feeding the drawn developer form S poles. A magnet having a normal direction magnetic force not less than 120 mT at the surface of the developing roller is used as a main magnet P1*b*. When both the main magnet P1*b* and the auxiliary magnet P1*c* positioned on a downstream side of the main magnet P1*b* have a magnetic force, for example, not less than 100 mT, problems such as adhesion of carrier particles on a photoreceptor 1 are not caused. When the magnets have a magnetic force not greater than 100 mT, the carrier adhesion problem is caused. The tangential magnetic force mainly influences on the carrier adhesion problem. In order to increase the tangential magnetic force, the magnetic force of P1*b* and P1*c* has to be increased. Occurrence of the carrier adhesion problem can be prevented by sufficiently increasing the magnetic force of either the main magnet or the auxiliary magnets. In this example, the width of the magnets P1*a*, P1*b* and P1*c* is 2 mm. In addition, the half value central angle is 16° in this case. When the half value central angle of the main magnet is greater than 25°, an abnormal image tends to be produced. For comparison, magnetic forces of a conventional magnetic roller are illustrated in FIG. 4.

The half value central angles of the auxiliary magnets P1*a* and P1*c* are preferably not greater than 35°. In addition, as illustrated in FIG. 3, the angle formed by the auxiliary magnet P1*a* or P1*c* and the main magnet P1*b* is preferably not greater than 30°. In the above-mentioned example, the angle is set to 25° such that the half value central angle of the main magnet is 16°. Further, the angle between the transition point, where polarity changes from the N pole to the S pole or vice versa, of the auxiliary magnetic pole P1*a* and the magnetic pole P6 and the transition point of the auxiliary magnetic pole P1*c* and the magnetic pole P2 is set to not greater than 120°.

The magnetic flux density of the main magnetic pole P1*b* in a normal line direction is 120 mT at the sleeve surface and is 55.8 mT at a point distanced from the sleeve surface by 1 mm. Namely, the variation of the magnetic flux density thereof in a normal line direction is 64.2 mT, and the attenuation ratio thereof is 53.5% (i.e., (64.2/120)×100). The magnetic flux density of the auxiliary magnetic pole P1*a* located on an upstream side from the main magnetic pole P1*b* in a normal line direction is 100 mT at the sleeve surface and is 53.3 mT at a point distanced from the sleeve surface by 1 mm. The variation of the magnetic flux density thereof in a normal line direction is 46.7 mT, and the attenuation ratio thereof is 46.7%. The auxiliary magnetic pole P1*c* located on an downstream side from the magnetic flux density of the main magnetic pole P1*b* in a normal line direction is 120 mT at the sleeve surface and is 67.4 mT at a point distanced from the sleeve surface by 1 mm. The variation of the magnetic flux density thereof in a normal line direction is 52.6 mT, and the attenuation ratio thereof is 43.8%.

In this example, among the magnet brushes formed by the developer along the lines of magnetic forces of the magnet roller, only the brush formed on the main magnet P1*b* is brought into contact with a photoreceptor and an electrostatic latent image on the photoreceptor is developed with the brush. When the magnet brush is observed while not being brought into contact with the photoreceptor, it is found that the magnet brush has a length of about 1 mm, and is shorter than the magnet brushes formed by conventional magnet rollers. Namely, the magnetic brush is thicker than the conventional magnetic brushes.

When the gap between the developer controlling member and the developing sleeve is the same as that of conventional developing devices, the amount of the developer passing the gap is the same. Therefore, it is confirmed that the magnetic brush in the developing region in the present invention is shorter and thicker than that of the conventional developing devices. The reason therefor is as follows. Since the magnetic flux density in a normal line direction at a point distanced from the developing sleeve by 1 mm is greatly decreased in the present invention, a brush chain cannot be formed at a point distanced from the developing sleeve and therefore the magnet brush is short, i.e., a thick magnet brush is formed on the surface of the developing sleeve.

In a case of the conventional magnet roller illustrated in FIG. 4, the magnetic flux density in a normal line direction at the surface of the sleeve is 90 mT, the magnetic flux density in a normal line direction at a point distanced from the surface of the sleeve by 1 mm is 63.9 mT, the variation of the magnetic flux density in a normal line direction is 26.1 mT, and the attenuation ratio is 29% which is much smaller than that in the developing roller in the present invention.

In addition, it is possible to control the attenuation ratio so as to be not less than 40% or to control the half value central angle so as to be less than 25° by setting magnets such that the angle therebetween is not greater than 35°.

In addition, it is preferable that the magnetic flux density in a normal line direction of the main magnetic pole P1*b* is 120 mT at the surface of the developing sleeve (i.e., within a range of from 100 to 200 mT).

When the attenuation ratio is less than 40%, the magnet brush tends to be long. Since the developing gap is narrow in the present embodiment, the magnet brush contacts a surface of the photoconductive drum, which surface has not reached to a developing nip region, and thereby appropriate development cannot be performed.

In order to increase the attenuation ratio, methods such as selecting proper magnet materials for the development magnetic pole and strongly turning the line of magnetic force generating from the development magnetic pole inside. Specific examples of the latter method include a method in which the development magnetic pole is constituted of a main magnetic pole erecting the magnet brush and auxiliary magnets which have an opposite pole and are positioned on upstream and downstream sides of the main magnet relative to the rotating direction of the developer bearing member. In addition, there is another method in which by providing a magnetic pole, such as a transfer magnetic pole, other than the development magnetic pole, the line of magnetic force generating from the development magnetic pole is turned inside, resulting in narrowing of the half width of the development magnetic pole. The half width is preferably set to not greater than 22° and more preferably not greater than 18°. It is experimentally confirmed that the attenuation ratio increases when the half width of the development magnetic pole is narrowed. When the half width is not greater than 25°, the magnetic flux density in a radial direction is decreased, resulting that the magnet brush hardly has a high density.

In addition, the line of magnetic force of the main magnetic pole (P1*b*) can be turned inside by providing auxiliary magnetic poles (P1*a* and P1*c*). In this case, the magnet brush is formed uniformly without changing the length in the longitudinal direction in the developing region and thereby the rear-end omission problem in that white spots are formed at a rear end in the longitudinal direction of an image can be avoided.

When the above conditions are fulfilled in the method in which a magnet brush formed by the main magnet is brought into contact with a photoreceptor to develop a latent image, and the developing nip is set to be not less than the particle diameter of a developer and not greater than 2 mm, a problem in that a white spots (omissions) are formed at an end portion of images can be avoided, and small images such as horizontal thin lines and 1-dot images can be well produced.

Figure 5:
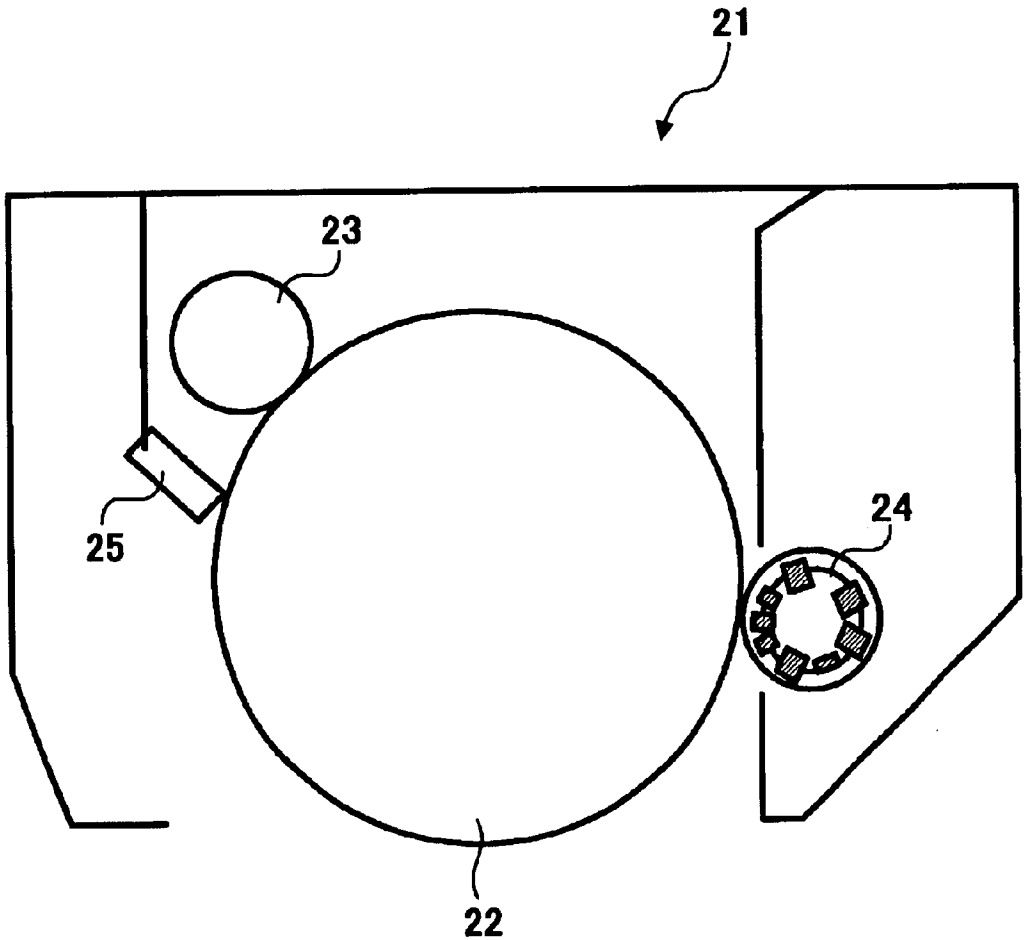
FIG. 5 is a schematic view illustrating the cross section of an embodiment of the process cartridge of the present invention.

FIG. 5 is a schematic view illustrating the cross section of an embodiment of the process cartridge of the present invention. Numeral 21 denotes a process cartridge. The process cartridge 21 includes a photoreceptor 22 serving as an image bearing member bearing an electrostatic latent image thereon, a charger 23 which charges the photoreceptor 22, a developing roller 24 serving as a member of a developing device which develops the electrostatic latent image on the photoreceptor 22 with the developer of the present invention to form a toner image on the photoreceptor 22, and a cleaning blade 25 which serves as a cleaner and which removes toner particles remaining on the surface of the photoreceptor 22 after the toner image on the photoreceptor 22 is transferred onto a receiving material (not shown).

Figure 3:
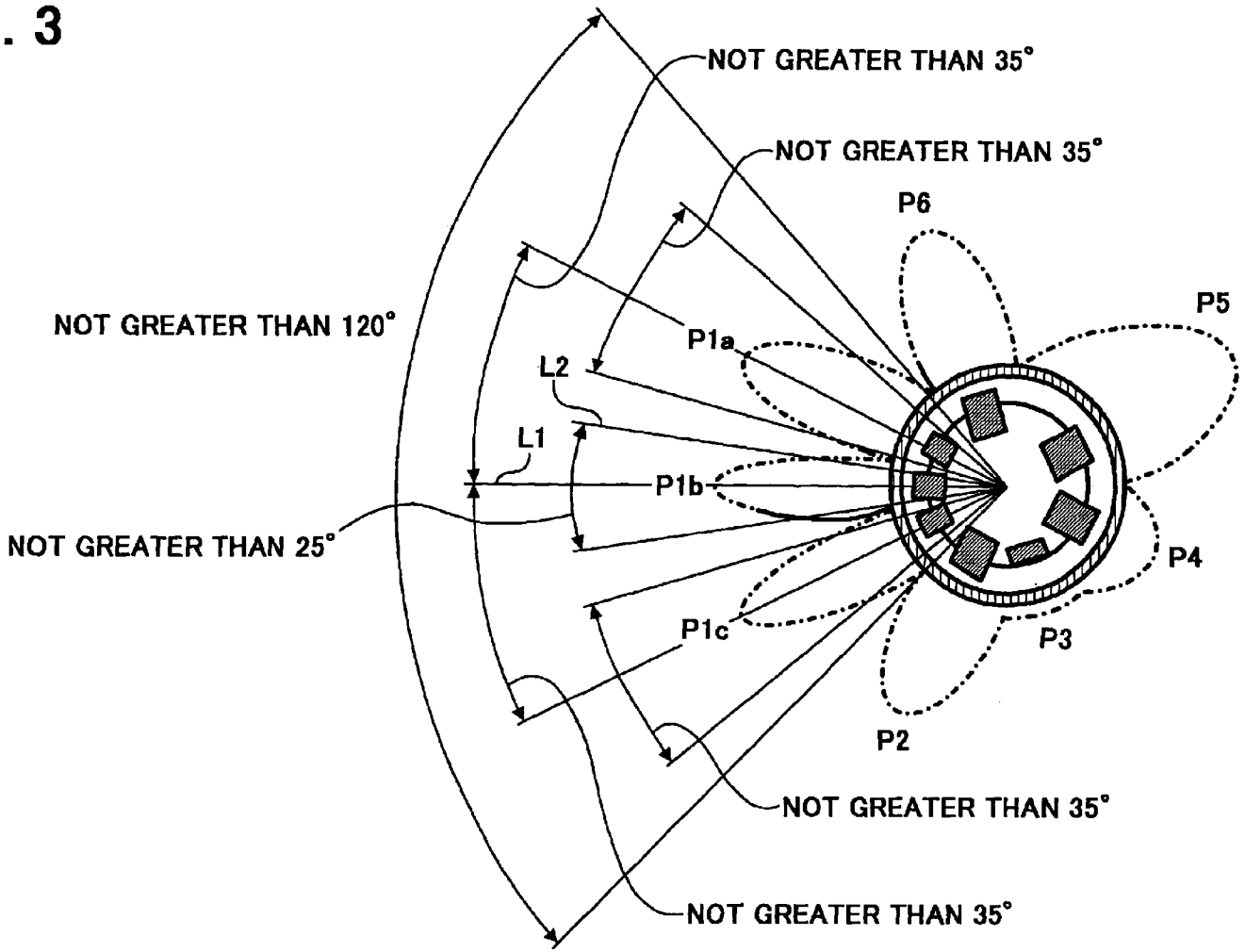
FIG. 3 is a schematic diagram for explaining the constitution of a developing sleeve for use in the image forming apparatus of the present invention.

The process cartridge is not limited to the process cartridge 21 illustrated in FIG. 3. Any process cartridges including at least an image bearing member and a developing device including the toner of the present invention can be used as the process cartridge of the present invention.

The process cartridge of the present invention is detachably set in an image forming apparatus. In the image forming apparatus in which the process cartridge is set, the photoreceptor 22 is rotated at a predetermined rotation speed. The photoreceptor 22 is charged with the charger 23 and thereby the photoreceptor 22 is uniformly charged positively or negatively. Then an image irradiating device (not shown) irradiates the charged surface of the photoreceptor 22 with light using a method such as slit irradiation methods and laser beam irradiation methods, resulting in formation of electrostatic latent image on the photoreceptor 22.

The thus prepared electrostatic latent image is developed by the developing roller 24 bearing the developer of the present invention thereon, resulting in formation of a toner image on the photoreceptor 22. The toner image is then transferred onto a receiving material (not shown) which is timely fed by a feeding device (not shown) to a transfer position between the photoreceptor 22 and a transfer device (not shown).

The toner image formed on the receiving material is then separated from the photoreceptor 22 and fixed by a heat/pressure fixing device (not shown) including a fixing roller. The fixed image is discharged from the image forming apparatus. Thus, a hard copy is produced.

The surface of the photoreceptor 22 is cleaned by the cleaning blade 25 to remove toner remaining on the photoreceptor 22, followed by discharging, to be ready for the next image forming operation.

Figure 6A:
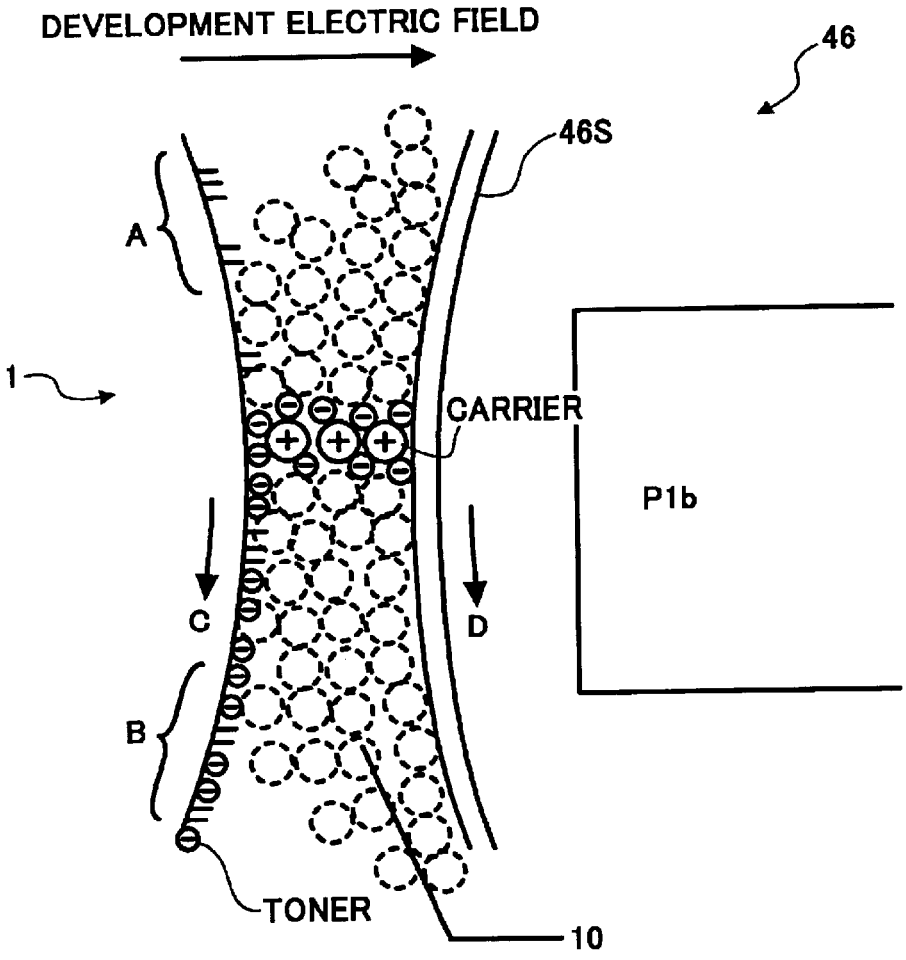
FIGS. 6A–6D are schematic views of the developing portion of a magnet brush developing device and views for explaining the mechanism of formation of white spots at a rear end of an image.

FIG. 6A illustrates the developing portion of a magnet brush developing device using a negative-positive developing method and a two-component developer. A developing roller 46 serving as a developer bearing member is illustrated in a right side of FIG. 6A and a photoreceptor 1 is illustrated in a left side of FIG. 6A. The developing roller 46 includes the developing sleeve 46*s* rotating in a direction (D) and development magnets poles fixed therein.

The two-component developer including a non magnetic toner and a magnetic carrier is transferred to a portion of the developing roller facing the photoreceptor 1 by a rotation of the developing sleeve 46*s*. In the portion facing the photoreceptor 1, the carrier of the two-component developer is erected by the magnetic force of a development magnetic pole, resulting in formation of a magnet brush.

In FIG. 6A, a small circle represents the toner particles and a large circle represents the carrier particles. For explanation convenience, only one pile of the magnet brush in the developing portion is illustrated in a full line while other magnet brushes are illustrated in dot lines and the toner particles therein are not illustrated.

On the other hand, the photoreceptor 1 bears an electrostatic latent image on the surface thereof and rotates in a direction (C). In FIG. 6A, a non-image portion of the electrostatic latent image illustrated as (A) is negatively charged. In the portion where the photoreceptor 1 faces the developing roller 46, the latent image on the surface of the photoreceptor is rubbed with the magnet brush and toner particles adhere to an image portion due to the development electric field. As a result, on a downstream side from the developing portion, a toner image is formed in the image portion of the latent image on the surface of the photoreceptor 1 as illustrated as (B). In this case, the portion of the photoreceptor where the magnet brush rubs the surface of the portion is referred to as a nip portion. In addition, a proper image density cannot be obtained when only a point of the developer bearing member rubs a point of the photoreceptor, and therefore the photoreceptor and the developing sleeve rotate at a different speed such that plural points of the developer bearing member rub a point of the photoreceptor. Namely, the developing sleeve rotates faster than the photoreceptor.

Figure 6D:
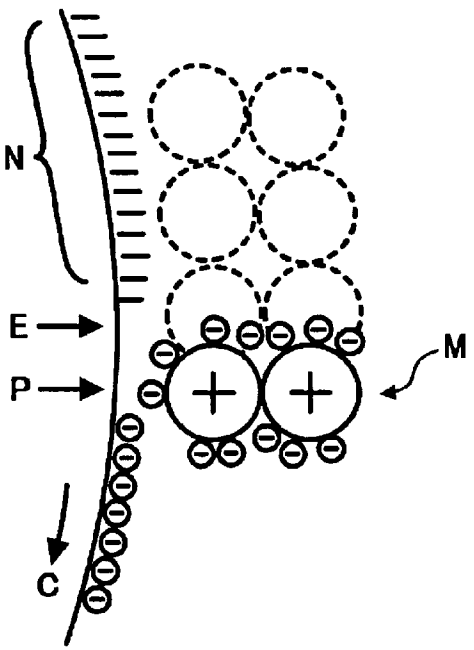
Figure 6C:
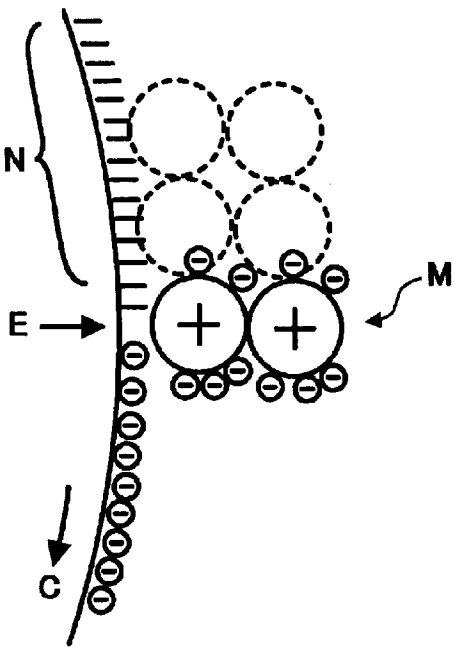
Figure 6B:
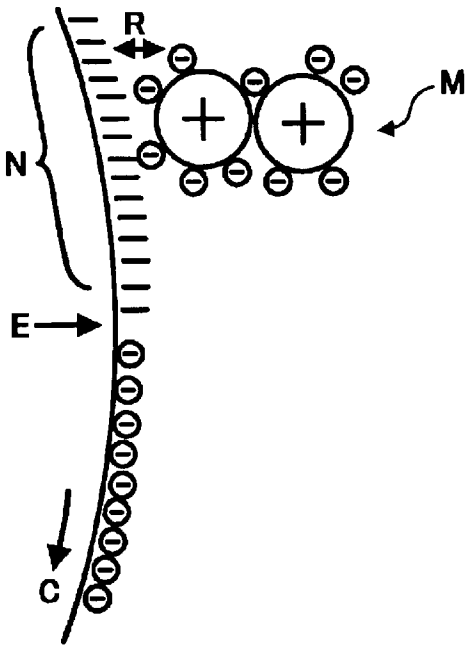

FIGS. 6B, 6C and 6D are views for explaining the mechanism of formation of white spots at a rear end of an image referring to this example. All of FIGS. 6B, 6C and 6D are enlarged views of the portion where the photoreceptor 1 and the developing sleeve faces each other in FIG. 6A. The edge of the magnet brush illustrated on a right side of each of FIGS. 6B, 6C and 6D approaches the photoreceptor illustrated on a left side of the figures. FIGS. 6B, 6C and 6D illustrate chronologically the rotation of the magnet brush in this order. Referring to FIGS. 6B, 6C and 6D, at the portion where the photoreceptor faces the developing roller, a border between a non-image portion and a black solid image is to be developed (namely "white spots" are to be formed at a rear portion of an image), and a toner image just developed is located on a downstream side from the portion in the rotating direction (C).

One of the magnet brush (M) approaches the photoreceptor in this state. Actually, the photoreceptor rotates in a counterclockwise direction (C), but as mentioned above, the developing sleeve is rotating faster than the photoreceptor, the magnet brush overtakes the photoreceptor. Therefore, in FIGS. 6B, 6C and 6D, the photoreceptor is illustrated as being stopped.

In FIG. 6A, the magnet brush approaching the photoreceptor passes through a non-image portion (N) before arriving at an edge (E) of the image portion to be developed. At this time, the non-image portion (N) and the toner particles repulse due to a repulsion force (R) therebetween, the toner particles are gradually removed from the photoreceptor, resulting in transfer of the toner particles toward the sleeve. Hereinafter this phenomenon is referred to as "toner drift". As a result of the toner drift, as illustrated in FIG. 6C, when the magnet brush reaches the edge (E) of the toner image, the surface of the positively charged carrier particles is exposed. Therefore, there is no toner particle on the magnet brush (M) for developing the edge (E) of the latent image and the edge (E) is not developed. Further, referring to FIG. 6D, when the magnet brush reaches a position P, the toner particles once adhered to the photoreceptor are transferred to the photoreceptor, if the adhesive force between the toner and the photoreceptor is low. As a result, there is a case when a development is not performed at a border between an image portion and a non-image portion, resulting in occurrence of the rear-end omission problem.

Then the toner for use in the present invention will be explained.

The present inventors discover that when a fine particle toner having a particle diameter of from 4.0 to 7.0 μm is used as the toner for the above-mentioned developing apparatus, fine components in the toner, especially fine particles not greater than 2 μm, mainly cause the on-sleeve toner fixation problem. Since adhesion between the toner and the sleeve is considered to be higher in a fine particle side of a toner than in a large particle side thereof, the on-sleeve toner fixation tends to proceed when the amount of fine particles included in the toner increases.

Namely, it is found that when the amount of fine particles having a particle size (i.e., a circle-equivalent particle diameter) not greater than 2 μm is not greater than 20% by number when measured by a flow particle image analyzer, the toner can produce images having high image qualities for a long period of time without causing the rear-end omission problem.

Conventionally, COULTER COUNTER, or the like instruments are used for measuring a particle diameter of a toner. Since this measuring method measures a particle diameter utilizing changes of resistance when the toner passes a fine pore, measurements of particle size not greater than 2 μm are greatly influenced by a noise, i.e., measurements are impossible due to lack of measuring accuracy. In contrast, the flow particle image analyzer measuring a particle size while performing an image analysis can measure the particle diameter of fine particles having a circle-equivalent particle diameter not greater than 2 μm. By using the flow particle image analyzer, it can be found that a toner including toner particles having a circle-equivalent particle diameter not greater than 2 μm in an amount not greater than 20% by number does not cause the on-sleeve toner fixation problem even when being repeatedly used for a long period of time.

The circle-equivalent particle diameter means the diameter of a circle having the same area as the projected area of a toner particle, and can be determined using a flow-type particle analyzer manufactured by SYSMEX. The method for determining the circle-equivalent particle diameter of a toner is as follows.

(1) 1 mg to 10 mg of a sample to be measured is mixed with 50 to 100 ml of 1% aqueous solution of sodium chloride which is prepared using a first grade sodium chloride and which is filtered using a filer having openings of 0.45 μm, and 0.1 ml to 0.5 ml of a dispersant (i.e., a surfactant) such as an alkylbenzene sulfonic acid salt;

(2) the mixture is dispersed using an ultrasonic dispersing machine for about 1 minute to prepare a suspension including particles of 5,000 to 15,000 per 1 micro-liter of the suspension;

(3) the circle-equivalent particle diameters of the particles of the sample are determined by the particle analyzer mentioned above; and (4) the percentage (% by number) of each of particle diameter ranges is calculated.

In this measurement, data of 0.6 μm or more in particle diameter are considered to be effective.

The toner of the present invention includes at least a wax and a binder resin. It is preferable that among the wax particles present in the toner, the wax particles present in a surface portion of the toner, which surface portion is defined as a surface portion having a depth of from 0 to 1 μm, have an area of from 5 to 30%. In particular, it is preferable that wax particles exist in the outer portion of the toner, which is defined as a surface portion having a depth of from 0 to half the radius of a toner particle, in an amount not less than 65% by number of the wax particles dispersed in the entire toner particle, so that a sufficient amount of wax can be exuded from the surface of the toner particles when the toner is fixed, resulting in impartment of good releasing property to the toner. In addition, the amount of wax particles at the uppermost surface of the toner can be reduced, and therefore transfer of the wax particles to a photoreceptor and a developing sleeve can be avoided. In particular, this toner can produce good effects when used for the developing method of the present invention in which a thick magnet brush is formed in the nip portion where a magnet brush rubs a photoreceptor, and thereby great heat and mechanical stresses are applied to the toner in a developing process.

When the surface portion of the toner having a depth of from 0 to 1 μm has a wax area less than 5%, the toner has insufficient releasing property. In addition, when the surface portion of the toner having a depth of from 0 to 1 μm has a wax area greater than 30%, filming of the toner (wax) on the photoreceptor and the developing sleeve may be seriously caused.

In addition, it is preferable for the toner of the present invention that the wax dispersed in the toner has a particle diameter distribution such that particles having a size of from 0.5 μm to 3 μm are present in an amount not less than 70% by number, and-more preferably particles having a size of from 1 μm to 2 μm are present in an amount not less than 70% by number. When particles having a size less than 0.5 μm are included in a large amount, good releasing property cannot be developed. In addition, when particles having a size greater than 3 μm are included in a large amount, fluidity deteriorates due to cohesion thereof. In addition, filming occurs, and color reproducibility and glossy property seriously deteriorate when the toner is used for color toners.

In the present invention, a diameter of a wax in the maximum length direction is defined as a wax dispersion diameter. Concretely, the wax dispersion diameter is measured as follows. A toner is embedded in an epoxy resin to cut finely to have a thickness of about 100 μm, followed by dyeing with ruthenium tetraoxide. Then a cross-sectional surface of the toner is observed with a transmission electron microscope with a 10,000 magnification power and photographed. By evaluating images of 20 particles, the dispersion diameter of the toner is determined.

The wax area ratio of the surface portion of the toner having a depth of from 0 to 1 μm is determined as an area ratio of the wax present in the surface portion of the toner having a depth of from 0 to 1 μm to that in the entire toner.

The wax particles existing in the outer portion of the toner means the wax particles which exist in the outer portion of the toner when the toner particle is divided into two portions by a curve connecting intermediate points between the center of the toner particle and the surface of the toner (in this case, toner particles existing at the surface of the toner are excluded). In this case, the wax particles existing on the curve are considered to be included in the inner portion. This outer portion is sometimes referred to as "an outer portion having a depth of from 0 to half a radius of the toner particle."

Suitable waxes for use as the wax in the toner of the present invention include carnauba waxes subjected to a treatment of removing a free aliphatic fatty acid, rice waxes and montan waxes. In particular, the carnauba waxes subjected to a treatment of removing a free aliphatic fatty acid have small volatile component, and thereby the effect of preventing occurrence of filming of the toner on a photoreceptor and the spent carrier problem can be produced. In addition, since waxes exude from a surface of the toner when fixing to impart a releasing property to the toner, waxes preferably have a low acid value not greater than 5 KOH mg/g, for example, by being subjected to a treatment of removing a free aliphatic fatty acid. Waxes are preferably included in the toner in an amount of from 2.0 to 12 parts by weight, and more preferably from 4.0 to 8.0 parts by weight, based on 100 parts by weight of the toner to impart good fixability to the toner.

Then the binder resin of the toner will be explained in detail.

In the present invention, modified polyester resins are preferably used as the binder resin of the toner of the present invention. Polyester prepolymers having an isocyanate group can be used for the modified polyester resins. Specific examples of the polyester prepolymers (A) having an isocyanate group include polyesters prepared by poly condensing a polyol (1) and a polycarboxylic acid (2) and reacting active hydrogen groups of the condensation product with a polyisocyanate (3). Specific examples of the active hydrogen groups include hydroxyl groups (alcoholic hydroxyl groups and phenolic hydroxyl groups), amino groups, carboxyl groups and mercapto groups. Among these groups, alcoholic hydroxyl groups are most preferable.

Specific examples of the polyols (1) includes diols (1-1) and polyols (1-2) having not less than 3 hydroxyl groups. It is preferable to use a diol (1-1) by itself or a mixture of a diol (1-1) and a small quantity of a polyol (1-2). Specific examples of the diols (1-1) include alkylene glycol (such as ethylene glycol, 1,2-propylene glycol, 1,3-propylene glycol, 1,4-butanediol and 1,6-hexanediol); alkylene ether glycol (such as diethylene glycol, triethylene glycol, dipropylene glycol, polyethylene glycol, polypropylene glycol and polytetramethylene ether glycol); alicyclic diol (such as 1,4-cyclohexane dimethanol and hydrogenate bisphenol A); bisphenol (such as bisphenol A, bisphenol F and bisphenol S); additives of alkylene oxide of the above-mentioned alicyclic diol (ethylene oxide, propylene oxide and butylenes oxide) and additives of alkylene oxide of the above-mentioned bisphenol (such as ethylene oxide, propylene oxide and butylenes oxide) Among these polyols, alkylene glycol having from 2 to 12 carbon atoms and alkylene oxide adducts of bisphenols are preferable. More preferably alkylene oxide adducts of bisphenol, and combinations thereof and alkylene glycols having from 2 to 12 carbon atoms are used. Specific examples of the polyols (1-2) having not less than 3 hydroxyl groups include polyhydric aliphatic alcohols having from 3 to 8 or more hydroxyl groups (such as glycerin, trimethylol ethane, trimethylol methane, pentaerythritol and sorbitol); phenol having not less than 3 hydroxyl groups (such as trisphenol PA, phenol novolak and cresol novolak); the above-mentioned alkylene oxide adducts of polyphenols having not less than 3 hydroxyl groups.

Specific examples of polycarboxylic acids include dicarboxylic acids (2-1) and polycarboxylic acids (2-2) having not less than 3 carboxylic groups. It is preferable to use dicarboxylic acid (2-1) itself and a mixture of a dicarboxylic acid (2-1) and a small quantity of a polycarboxylic acid (2-2). Specific examples of the dicarboxylic acid (2-1) include alkylene dicarboxylic acids (such as succinate, adipic acid and sebacic acid); alkenylene dicarboxylic acids (such as maleic acid and fumaric acid); aromatic dicarboxylic acids (such as phthalic acid, isophthalic acid, terephthalic acid and naphthalene dicarboxylic acid). Among these acids, alkenylene dicarboxylic acids having from 4 to 20 carbon atoms and aromatic dicarboxylic acids having from 8 to 20 carbon atoms are preferable. Specific examples of the polycarboxylic acids (2-2) having not less than 3 carboxylic groups include aromatic polycarboxylic acids having from 9 to 20 carbon atoms (such as trimellitic acid and pyromellitic acid). As the polycarboxylic acid (2), acid anhydrides of the above-mentioned acids and lower alkyl esters (such as methyl ester, ethyl ester and isopropyl ester) of the acids can also be used.

The mixing ratio of a polyol (1) to a polycarboxylic acid (2) i.e., equivalent ratio of a hydroxyl group [OH] to a carboxyl group [COOH] ([OH]/[COOH]), is normally from 2/1 to 1/1, preferably from 1.5/1 to 1/1 and more preferably from 1.3/1 to 1.02/1.

Specific examples of the polyisocyanates (3) include aliphatic polyisocyanates (tetramethylene diisocyanate, hexane methylene diisocyanate and 2,6-disocyanate methylcaproate); alicyclic polyisocyanates (such as isophorone diisocyanate, cyclohexyl methane diisocyanate and diphenyl methane diisocyanate); aromatic aliphatic diisocyanate (such as $\alpha,\alpha,\alpha',\alpha'$-tetramethyl xylylene diisocyanate); isocyanurates; blocked isocyanates prepared by blocking the above-mentioned isocyanate with phenol derivatives, oxime, caprolactam and the like; and combinations thereof.

The mixing ratio of a polyisocyanate (3) i.e., equivalent ratio of an isocyanate group [NCO] to a hydroxyl group [OH] ([NCO]/[OH]), is normally from 5/1 to 1/1, preferably from 4/1 to 1.2/1 and more preferably from 2.5/1 to 1.5/1. When the ratio [NCO]/[OH] exceeds 5, the low temperature fixability of the toner deteriorates. When the mole ratio of [NCO] is less than 1, the quantity of urea bonding in the resultant modified polyester lowers and the hot offset resistance of the toner deteriorates. The polyisocyanate (3) content in the prepolymer A having an isocyanate group at an end thereof is normally from 0.5 to 40 weight %, preferably from 1 to 30 weight %, and more preferably from 2 to 20 weight %. When the content is less than 0.5 weight %, hot offset resistance of the toner deteriorates and a good combination of high temperature preservability and low temperature fixability cannot be imparted to the toner. In addition, when the content exceeds 40 weight %, the low temperature fixability of the toner deteriorates.

Isocyanate groups are contained in the prepolymer (A) in an amount not less than one, preferably from 1.5 to 3 in average, and more preferably from 1.8 to 2.5 in average per one molecule of the prepolymer (A). When the content of isocyanate groups is too low, the molecular weight of the resultant modified polyester after the polyester is crosslinked or extended lowers and thereby the hot offset resistance of the toner deteriorates.

In the present invention, when the polyester resins are crosslinked or extended, amines can be used as crosslinking agents and/or extension agents. Specific examples of the amines (B) include diamines (B1), polyamines (B2) having not less than 3 amino groups, amino alcohols (B3), amino mercaptans (B4), amino acids (B5) and amines (B6) in which the amino groups of from B1 to B5 are blocked. Specific examples of the diamines (B1) include aromatic diamines (such as phenylenediamine, diethyltoluene diamines and 4,4'diaminopheynylmethane); alicyclic diamines (such as 4,4'-diamino-3,3' dimethyl dicyclohexylmethane, diamine cyclohexane and isophorone diamine) and aliphatic diamines (such as ethylenediamine, tetramethylendiamine and hexamethylenediamine). Specific examples of the polyamine (B2) having not less than 3 amino groups include diethylenetriamine and triethylene tetramine. Specific examples of the amino alcohols (B3) include ethanol amine and hydroxyethyl aniline. Specific examples of the amino mercaptans (B4) include amino ethyl mercaptan and amino propyl mercaptan. Specific examples of the amino acids (B5) include aminopropionic acid and aminocaproic acid. Specific examples of the blocked amines (B6) include ketimine compounds prepared by reacting the above-mentioned amines from B1 to B5 with ketones (such as acetone, methyl ethyl ketone and methyl isobutyl ketone) and oxazoline compounds. Among these amines (B), mixtures of a diamine (B1) and a small quantity of a polyamine (B2) are preferable.

Furthermore, crosslinking and/or extension can be controlled using a terminator to adjust the molecular weight of the resultant modified polyester. Specific examples of the terminators include monoamine (such as diethyl amine, dibutyl amine, butyl amine and lauryl amine) and blocked amines (ketimine compounds).

The mixing ratio of an amine (B) to a prepolymer (A), i.e., an equivalent ratio of an isocyanate group [NCO] in the prepolymer (A) to an amino group [NHx] in the amine (B) ([NCO]/[NHx]), is normally from 1/2 to 2/1, preferably from 1.5/1 to 1/1.5 and more preferably from 1.2/1 to 1/1.2. When the ratio [NCO]/[NHx] exceeds 2 or is less than 1/2, the molecular weight of the resultant urea modified polyester (i) lowers and thereby the hot offset resistance of the toner deteriorates.

In the present invention, the above-mentioned modified polyesters can be used as a toner binder alone. But a non-modified polyester (C) can be used together with the modified polyesters. By adding a non-modified polyester (C), the low temperature fixability of the toner can be improved. In addition, glossiness increases when the toner is used in a full-color printing apparatus. Specific example of the non-modified polyesters (C) includes polycondensation products of polyols (1) and the polycarboxylic acids (2) mentioned above for use in the polyesters (A). In addition, the non-modified polyesters (C) are not limited to the non-modified polyesters, and polyesters modified by a chemical bonding other than urea bonding. For example, polyesters modified by a urethane bonding can be used as the non-modified polyesters. The modified polyesters (A) and non-modified polyesters (C) preferably soluble to each other, at least partially in terms of the low temperature fixability of the toner. Therefore, the polyester components (A) and (C) preferably have a similar composition. The weight ratio of the modified polyesters (A) and the non-modified polyesters (C) is normally from 5/95 to 75/25, preferably from 10/90 to 25/75, more preferably from 12/88 to 25/75 and most preferably from 12/88 to 22/78. When the weight ratio of the modified polyester (A) is less than 5%, the hot offset resistance of the toner deteriorates and a good combination of high temperature preservability and low temperature fixability cannot be imparted to the toner.

The peak molecular weight of the non-modified polyesters (C) is normally from 1,000 to 30,000, and preferably from 2,000 to 8,000. When the molecular weight is less than 1,000, high temperature fixability of the toner deteriorates. When the molecular weight exceeds 10,000, low temperature fixability of the toner deteriorates. The hydroxyl value of the non-modified polyesters (C) is preferably not less than 5, more preferably from 10 to 120 and most preferably from 20 to 80. When the hydroxyl value is less than 5, the hot offset resistance of the toner deteriorates and a good combination of high temperature preservability and low temperature fixability cannot be imparted to the toner. The acid value of non-modified polyester (C) is normally from 0.5 to 40 and preferably from 5 to 35. When such a non-modified polyester (C) is used, the resultant toner tends to have negative chargeability. In addition, non-modified polyesters (C) having an acid value and a hydroxyl group greater than the above-mentioned ranges tend to change their properties in high temperature and high humidity conditions and low temperature and low humidity conditions, and thereby the image qualities tend to deteriorate.

Suitable materials for use as the colorant in the toner of the present invention include known pigments and dyes. Specific examples of the pigments and dyes include carbon black, Nigrosinedyes, lampblack, ironblack, Naphthol yellow S, Hansa yellow (10G, 5G, G), Cadmium yellow, yellow iron oxide, yellow ocher, titan yellow, poly azo yellow, oil yellow, Hansa yellow (GR, A, RN, R), pigment yellow L, benzine yellow (G, GR), permanent yellow (NCG), Vulcan Fast Yellow (5G, R), Tartrazine Lake, quinoline yellow rake, Anthracene Yellow BGL, iso-indolinone yellow, colcothar, red lead, orange lead, Cadmium red, Cadmium mercury red, antimony orange, Permanent red 4R, Para Red, Fire Red, Parachlor ortho-nitro aniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake Y, Alizarine Lake, Thioindigo red, Thioindigo maroon, Oil Red, quinacridone red, pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), Indigo, ultramarine, Prussian blue, Anthraquinone Blue, Fast Violet B, Methyl Violet Lake, cobalt violet, manganese violet, dioxane violet, anthraquinone Violet, Chrome Green, zinc green, chromium oxide, viridian, emerald green, Pigment Green B, Naphthol Green B, Green Gold, Acid Green Lake, Malachite Green Lake, phthalocyanine Green, Anthraquinone Green, titanium oxide, zinc oxide, Lithopone and compounds thereof. The colorant is contained in the toner in an amount of from 1 to 15% by weight and preferably from 3 to 10% by weight based on the total weight of the toner.

The colorants can be used together with resins to be used as a complex compound, i.e., a masterbatch. Specific examples of the binder resins which are use for manufacturing the masterbatch or kneaded with a masterbatch include the above-mentioned modified or non-modified polyester resins, polymers of styrene and substitution compounds of styrene thereof; such as polystyrene, polypchlorostyrene and polyvinyl toluene; styrene copolymers such as styrene-p-chlorostyrene copolymers, styrene-propylene copolymers, styrene-vinyl toluene copolymers, styrene-vinyl naphthalene copolymers, styrene-acrylic methyl copolymers, styrene-acrylic ethyl copolymers, styrene-acrylic butyl copolymers, styrene-acrylic octyl copolymers, styrene-methacrylic methyl copolymers, styrene-methacrylic ethyl copolymers, styrene-methacrylic butyl copolymers, styrene-α-chloro methacrylic methyl copolymers, styrene-acrylonitrile copolymers, styrene-vinyl methyl ketone copolymers, styrene-butadiene copolymers, styrene-isoprene copolymers, styrene-acrylonitrile-indene copolymers, styrene maleic copolymers and styrene maleic ester copolymers; polymethyl methacrylate, polybutyl methacrylate, polyvinylchloride, polyvinyl acetate, polyethylene, polypropylene, polyester, epoxy resins, epoxy polyol resins, polyurethane, polyamide, polyvinyl butyral, polyacrylic resins, rosins, modified rosins, terpene resins, aliphatic or alicyclic carbon hydride resins, aromatic oil resins, chlorinated paraffin and paraffin waxes. These resins are used alone or in combination.

The masterbatch can be prepared by mixing and kneading a resin and a colorant for masterbatch with application of high shearing force. At this time, an organic solvent can be used for improving an interaction between the colorant and the resin. In addition, a flushing method in which water paste including water and a colorant is mixed and kneaded with a resin and an organic solvent to shift the colorant to the resin side, followed by removal of water and the organic solvent is preferably used to prepare a masterbatch. The wet cake of the colorant can be used as it is, without drying the mixture. A dispersion apparatus applying high shearing force such as three-roll mills is preferably used for mixing and kneading.

The toner of the present invention can optionally include a charge controller. All known charge controllers such as Nigrosine dyes, triphenylmethane dyes, metal complex dyes including chrome, chelate molybdate dyes, rhodamine dyes, alkoxy amine dyes, quaternary ammonium salts (including fluoric modified quaternary ammonium), alkyl amide, simple substance of phosphorus or compounds thereof, simple substance of tungsten or compounds thereof, fluoric active agents, salicylate metal salts and metal salts of salicylate derivatives can be used for the toner. Specific examples of the charge controllers include BONTRON 03 of a Nigrosine dye, BONTRON P-51 of a quaternary ammonium salt, BONTRON S-34 of an azo dye including a metal, E-82 of a hydroxynaphthoic acid metal complex, and E-89 of a phenol condensation product (manufactured by Orient Chemical Industries Co., Ltd.); TP-302 and TP-415 of quaternary ammonium salt molybdenum complexes (manufactured by Hodogaya Chemical Co., Ltd.), COPY CHARGE PSY VP2038 of a quaternary ammonium salt, COPY BLUE PR of a triphenylmethane derivative, COPY CHARGE NEG VP2036 and COPY CHARGE NX VP434 of quaternary ammonium salts (manufactured by Hoechst AG); LRA-901 and LR-147 of a boric complex (manufactured by Japan Carlit Co., Ltd.); copper phthalocyanine, perylene, quinacridone, azo pigments, polymers having a functional group such as sulfonic acid groups, carboxylic groups and quaternary ammonium salt groups.

In the present invention, the content of charge controller is determined depending on the kind of binder resin used, whether an additive is added and the toner manufacturing method and is not limited to a specific range. However, the quantity is preferably from 0.1 to 10 parts by weight, and more preferably from 0.2 to 5 parts by weight based on 100 parts by weight of the binder resin. When the quantity exceeds 10 parts by weight, the resultant toner has too large, a chargeability of a main charge controller decrease and electrostatic inter action of the toner and a developing roller increases, resulting in deterioration of fluidity of the developer and image density. These charge controllers can be melted and kneaded together with the masterbatch and the resins, and can also be added when toner constituents are dissolved and dispersed in organic solvents. Furthermore, the charge controller can be externally mixed with toner particles using a Henschel mixer or the like.

The thus prepared toner particles can be mixed with an external additive. Inorganic fine particles can be preferably used as the external additive to improve fluidity, developing property and charging property of the toner particles. The primary particle diameter of the inorganic fine particles is preferably from 5 nm to 2 $\mu$m and more preferably from 5 nm to 500 nm. In addition, specific surface area of the inorganic fine particles measured by a BET method is preferably from 20 to 500 $m^2/g$. The content of the inorganic fine particles is preferably from 0.01 to 5% by weight and more preferably from 0.01 to 2.0% by weight, based on the toner particles. Specific examples of the inorganic fine particles include silicas, aluminas, titanium oxide, barium titanate, magnesium titanate, strontium titanate, zinc oxide, tin oxide, silica sands, clays, micas, wollastnite, diatom earth, chromium oxide, cerium oxide, red iron oxide, antimony trioxide, magnesium oxide, zirconium oxide, barium sulfate, barium carbonate, calcium carbonate, silicon carbide and silicon nitride.

In addition, fine polymer particles can be used as the external additive. Specific examples of the fine polymer particles include fine particles of polymers such as polystyrene obtained by a soap free emulsionation polymerization, suspension polymerization and dispersion polymerization, polycondensation such as methacrylic ester, acrylic ester copolymers and silicone, benzoguanamine and nylon and polymer particles by thermosetting resins.

The external additives are preferably subjected to a hydrophobizing treatment to prevent deterioration of charge property and fluidity under high humidity conditions. Specific examples of the surface treatment agents include silane coupling agents, organic titanate coupling agents, sililating agents, silane coupling agents having alkyl fluoride group, organic titanate coupling agents, aluminum coupling agents, silicone oils and modified silicone oils.

The toner of the present invention may include cleaning property improver to improve the cleaning property of the toner remaining on a photoreceptor or a first transfer medium. Specific examples of the cleaning property improvers include fatty acid metal salts such as zinc stearate, calcium stearate and stearic acid and fine polymer particles prepared by a soap free emulsionation polymerization method, such as polymethyl methacrylate fine particles, and polystyrene fine particles. Polymer particles having a relatively narrow particle size distribution and a volume average particle diameter of from 0.01 to 1 $\mu$m are preferably used.

The toner of the present invention is mixed with a carrier to prepare a developer. Known materials can be used as the core particles of the carrier. Specific examples of the core particles include ferromagnetic metals such as iron, cobalt and nickel; metal alloys and compounds such as magnetite, hematite and ferrite; and complexes of the above-mentioned ferromagnetic fine particles and resins.

The surface of the carrier can be coated with a resin to improve durability of the carrier.

Specific examples of the resins forming the coating layer include polyolefin resins such as polyethylene, polypropylene, chlorinated polyethylene, chlorosulfonated polyethylene; polyvinyl and polyvinylidene resins such as polystyrene, acryl (for example, polymethyl methacrylate), polyacrylonitrile, polyvinyl acetate, polyvinyl alcohol, polyvinyl butyral, polyvinyl chloride, polyvinyl carbazole, polyvinyl ether and polyvinyl ketone; chloroethene-vinyl acetate copolymers; silicone resins including organosiloxane bonding or modified thereof (for example, silicone resins modified by alkyd resins, epoxy resins and polyurethane resins); fluoro-resins such as polytetrafluoroethylene, polyvinyl fluoride, polyvinylidene fluoride, polychlorotrifluoroethylene; polyamide; polyester; polyurethane; polycarbonate;

amino resins such as urea-formaldehyde resins; and epoxy resins. Among the resins, the silicone resins or modified silicone resins are preferable because of imparting good toner filming resistance to the carrier.

Any known silicone resins can be used as the silicone resins. Specific examples of silicone resins include straight silicone resins including an organosiloxane bonding having the following formula (1):

Formula 1

(1)

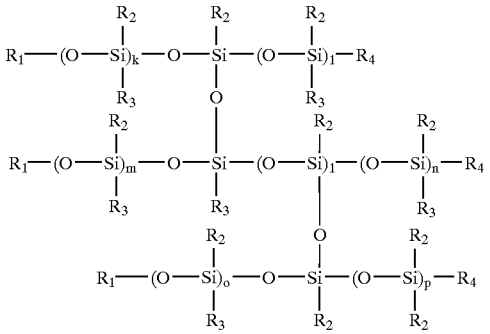

wherein $R_1$ represents a hydrogen atom, an alkyl group having from 1 to 4 carbon atoms or a phenyl group; $R_2$ and $R_3$ independently represent a hydrogen atom an alkoxy group having from 2 to 4 carbon atoms, a phenyl group, a phenoxy group, an alkenyl group having from 2 to 4 carbon atoms, an alkenyloxy group having from 2 to 4 carbon atoms, a hydroxy group, a carboxyl group, an ethylene oxide group, a glycidyl group or a group having the following formula (2):

Formula 2

(2)

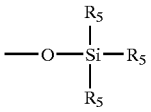

wherein R4 and R5 independently represent a hydroxy group, a carboxyl group, an alkyl group having from 1 to 4 carbon atoms, an alkoxy group having from 1 to 4 carbon atoms, an alkenyl group having from 2 to 4 carbon atoms, an alkenyloxy group having from 2 to 4 carbon atoms, a phenyl group, phenoxy group and k, l, m, n, o and p are independently an integer not less than 1. In addition, silicone resins modified with alkyd, polyester, epoxy urethane or the like can also be used.

Each of the above-mentioned substitution groups can have a substitution group such as amino groups, hydroxy groups, carboxyl groups, mercapto groups, alkyl groups, phenyl groups, ethylene oxide groups, glycidyl groups or halogen groups.

The carrier for use in the present invention can include an electroconductive imparting agent in the coating layer to control a volume resistivity of the carrier. Known electroconductive imparting agents can be used. Specific examples of the electroconductive imparting agents include metals such as iron, gold and copper; iron oxides such as ferrite and magnetite; and pigments such as carbon black.

In particular, using a compound of furnace black and acetylene black which are one of carbon blacks makes it possible to effectively adjust the electroconductive property and to prepare a carrier having a coating layer with high abrasion resistance. These electroconductive fine particles preferably have a particle diameter of from 0.01 to 10 $\mu$m. The addition amount thereof is preferably from 2 to 30 parts by weight, and more preferably from 5 to 20 parts by weight, based on 100 parts by weight of the coating resin.

In addition, a silane coupling agent, a titan coupling agent or the like can be added in the coating layer to improve adhesive property of the layer with core particles.

A compound having the following formula (3) is used as the silane coupling agent in the present invention.

$$YRSiX \quad (3)$$

wherein X represents a hydrolysis group combining with a silicon atom such as chloro groups, alkoxy groups, acetoxy groups, alkylamino groups and propenoxy groups; Y represents an organic functional group reacting with an organic matrix, such as vinyl groups, methacrylic groups, epoxy groups, glycydoxy groups, amino groups and mercapto groups. R represents an alkyl group having from 1 to 20 carbon atoms or an alkylene group.

Among the above-mentioned silane coupling agents, amino silane coupling agents having an amino group as the group Y are preferable for obtaining a developer having negative charge property.

The coating layer can be formed by any know method. For example, a coating layer forming liquid is coated on the surface of carrier core particles by a spraying method, a dipping method or the like. The coating layer preferably has a thickness of from 0.1 to 20 $\mu$m.

The toner for use in the present invention can be prepared by a conventionally known method. Concretely, a crushing method can be used, in which a mixture of a binder resin, and a polar controlling agent, optionally with an additive is melted and kneaded with a kneading roll mill, followed by cooling to be solidified. Then the mixture is crushed and classified, and the toner particles are mixed with an external agent to obtain a toner.

In addition, a polymerization method can also be used, in which toner constituents including a toner binder made of a modified polyester resin which can be reacted with an active hydrogen are dissolved or dispersed in an organic solvent, and the solution or dispersant is dispersed in a water solvent including fine particle resins to be reacted with a crosslinking agent and/or an extension agent, followed by removal of the solvent from the obtained dispersant. The toner particles are mixed with an external additive to prepare a toner.

Both the pulverization method and the polymerization method can be used in the present invention. The polymerization method will be explained in detail. The water solvent for use in the polymerization method can simply be water, but a solvent which can be blended with water can be used together with water. Specific examples of the solvent which can be blended with water include alcohols (such as methanol, isopropanol and ethylglycol), dimethylformamide, tetrahydrofuran, cellosolves (such as methyl cellosolve), and lower ketones (such as acetone and methyl ethyl ketone).

The toner particles can be formed in a water solvent by reacting a prepolymer (A) having an isocyanate group and dispersed therein with an amine (B) or by using a previously prepared urea modified polyester (i). In order to prepare a stable aqueous dispersion of the urea modified polyester (i) or prepolymer (A), a method in which toner constituents including the urea modified polyester (i) or prepolymer (A) are added in a water solvent and dispersed by applying a shearing force thereto. The toner constituents such as the prepolymer (A), a colorant masterbatch, a release agent, a charge controller and a non-modified polyester resin can be mixed when the dispersion is formed in the water solvent, but it is preferable that the toner constituents are mixed in advance, and then the mixture is added in the water solvent to be dispersed. In addition, in the present invention, the other toner constituents such as the colorant, the release agent and the charge controller are not necessarily added in the water solvent when particles are formed, and can be added after the formation of the particles. For example, the colorant can be added to particles having no colorants, which are previously formed with a known dyeing method.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 $\mu$m to 20 $\mu$m can be easily prepared. At this point, the particle diameter (2 to 20 $\mu$m) means a particle diameter of particles including a liquid).

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, a urea-modified polyester (i) or a prepolymer (A) can be easily dispersed because the dispersion has a low viscosity.

The weight ratio (T/M) of the toner constituents (T) (including a urea-modified polyester (i) or a prepolymer (A)) to aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory, and thereby the resultant mother toner particles do not have a desired particle diameter. In contrast, when the ratio is too small, the manufacturing costs increase.

A dispersant can be preferably used when a dispersion is prepared, to prepare a dispersion including particles having a sharp particle diameter distribution and to prepare a stable dispersion.

The process of synthesizing a urea-modified polyester (i) from a prepolymer (A) can be performed by react the prepolymer (A) with an amine (B) before dispersing the other toner constituents in the water solvent or by adding an amine (B) after the other toner constituents are dispersed in the water solvent to react the amine (B) with the surface of particles of the dispersion. In this case, the urea-modified polyester is preferentially generated on the surface of the toner particles and a concentration gradient of the urea-modified polyester can be formed in the toner particles.

Specific examples of the dispersants, which can disperse or emulsify an oil phase, in which toner constituents are dispersed, in an aqueous liquid, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a surfactant having a fluoroalkyl group, a dispersion having good dispersibility can be prepared even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6–C11)oxy}-1-alkyl(C3–C4) sulfonate, sodium 3-{omega-fluoroalkanoyl(C6–C8)-N-ethylamino}-1-propanesulfonate, fluoroalkyl(C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl(C6–C10) sulfoneamidepropyltrimethylammonium salts, salts of perfluoroalkyl(C6–C10)-N-ethylsulfonyl glycin, monoperfluoroalkyl(C6–C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6–C10)sulfoneamide propyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic dispersants which are hardly soluble in water such as tricalcium phosphate, calcium carbonate, titanium oxide, colloidal silicas and hydroxyapatite can also be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

In this case, when compounds such as calcium phosphate which are soluble in an acid or alkali are used as a dispersion stabilizer, it is preferable to dissolve calcium phosphate by adding an acid such as hydrochloric acid and to wash the resultant particles with water to remove calcium phosphate therefrom. In addition, calcium phosphate can be removed using a zymolytic method.

When a dispersant is used, the resultant particles are preferably washed after the particles are subjected to an elongation and/or a crosslinking reaction to impart good charge ability to the mother toner particles.

When an aqueous dispersion or emulsion is prepared, a solvent which can dissolve the urea-modified polyester (i) or prepolymer (A) used is preferably used because the resultant particles have a sharp particle diameter distribution. The solvent is preferably volatile and has a boiling point lower than 100° C. because of easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom upon application of heat thereto under a normal or reduced pressure after the particles are subjected to an elongation reaction and/or a crosslinking reaction.

The reaction time of extension and/or crosslinking is determined depending on the reacting property of the prepolymer (A) and the amine (B) used, but the reaction time is normally from 10 minutes to 40 hours, and preferably 2 hours to 24 hours. The reacting temperature is normally from 0 to 150° C. and preferably from 40 to 98° C. In addition, a known catalyst can optionally be used. Specific examples of the catalyst include dibutyltin laurate and dioctyltin laurate.

In order to remove an organic solvent from the prepared emulsion, a method can be used in which the temperature of the total system is increased to completely evaporate the organic solvent in the liquid drop. Alternatively, it is also possible to spray the prepared emulsion in a dry environment to remove a water-insoluble organic solvent and to form toner fine particles. In this case, an aqueous dispersant can also be evaporated and removed at the same time. Gases which are prepared by heating air, nitrogen, carbon dioxide or incineration gas, and especially various gasflows heated to a temperature higher than the boiling point the solvent having the highest boiling point in the solvent used, are generally used for the dry environment in which the emulsion is sprayed. Toner particles having target qualities can be obtained with a short period of time using a spray drier, belt drier, rotary kiln or the like.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to subject the liquid including the particles to the classification treatment in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared toner particles are then mixed with a releasing agent, a charge controller, a fluidizer, and/or a colorant upon application of mechanical impact thereto to fix the agents on the toner particles (i.e., to integrate the agents into the toner particles). Thus the agents are prevented from being released from the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Fine Particles Dispersion (1)

The following components were placed in a reacting container having a stirrer and a thermometer and rotated at a speed of 400 rpm for 15 minutes to prepare a white emulsion.

| | |
|---|---|
| Water | 683 parts |
| Sodium salt of sulfate of ethylene oxide adduct of methacrylic acid (ELEMINOL RS-30, manufactured by Sanyo Chemical Industries Ltd.) | 11 parts |
| Styrene | 83 parts |
| Methacrylic acid | 83 parts |
| Butyl acrylate | 110 parts |
| Ammonium persulfate | 1 part |

The emulsion was heated to 75° C. and reacted for 5 hours. Further, 30 parts of a 1% aqueous solution of ammonium persulfate was added and aged for 5 hours to prepare an aqueous dispersion of a vinyl resin (styrene-methacrylic acid-butyl acrylate-sodium salt of sulfate of ethylene oxide adduct of methacrylic acid copolymer. A volume average particle diameter of the fine particle dispersion (1) was 0.10 μm when measured with LA-920. A part of the fine particle dispersion (1) was dried to isolate a resin portion. The glass transition temperature (Tg) of the resin was 57° C.

Preparation of Water Phase (1)

| | |
|---|---|
| Water | 990 parts |
| Fine particle dispersant (1) | 80 parts |
| 48.5% aqueous solution of sodium salt of dodecyl diphenyl ether disulfonic acid (ELEMINOL MON-7, manufactured by Sanyo Chemical Industries Ltd.) | 40 parts |
| Ethyl acetate | 90 parts |

Preparation of Low Molecular Weight Polyester (1)

The following components were placed in a reacting container having a condenser, a stirrer and a nitrogen introducing tube and reacted 8 hours at 230° C. under normal pressure, followed by a reaction for 5 hours under reduced pressure of from 10 to 15 mmHg.

| | |
|---|---|
| Ethylene oxide adduct of bisphenol A | 220 parts |
| Propylene oxide adduct of bisphenol A | 561 parts |
| Terephthalic acid | 218 parts |
| Agipic acid | 48 parts |
| Dibutyl tin oxide | 2 parts |

Then, 45 parts of trimellitic anhydride were added thereto to be reacted for 8 hours at 230° C. to prepare a low molecular weight polyester (1). The low molecular weight polyester (1) had a number average molecular weight of 2500, a weight average molecular of 6700, a Tg of 43° C. and an acid value of 25.

Preparation of Intermediate Polyester (1)

The following components were placed in a reacting container having a condenser, a stirrer and a nitrogen introducing tube and reacted for 8 hours at 230° C. under normal pressure, followed by a reaction for 5 hours under a reduced pressure of from 10 to 15 mmHg to prepare an intermediate polyester (1).

| | |
|---|---|
| Ethylene oxide adduct of bisphenol A | 682 parts |
| Propylene oxide adduct of bisphenol A | 81 parts |
| Terephthalic acid | 283 parts |
| Trimellitic anhydride | 22 parts |
| Dibutyl tin oxide | 2 parts |

The intermediate polyester (1) had a number average molecular weight of 2100, a weight average molecular of 9500, a Tg of 55° C., an acid value of 0.5 and a hydroxyl value of 49.

Preparation of Prepolymer (1)

Next, 411 parts of the intermediate polyester (1), 89 parts of isophorone diisocyanate and 500 parts of ethyl acetate were placed in a reacting container having a condenser, a stirrer and a nitrogen introducing tube and reacted for 5 hours at 100° C. to prepare a prepolymer (1). The prepolymer (1) contained a free isocyanate in an amount of 1.53% by weight.

Preparation of Ketimine Compound (1)

In a reacting container having a stirrer and a thermometer, 170 parts of isophorone diamine and 75 parts of methyl ethyl ketone were placed and reacted for 5 hours at 50° C. to prepare a ketimine compound (1). The ketimine compound (1) had an amine value of 418 mgKOH/g.

Preparation of Masterbatch (1)

The following components were mixed with a Henshel mixer to prepare a compound in which water soaked into an agglomerated pigment.

| | |
|---|---|
| Carbon black (REGAL 400 L, manufactured by Cabot corporation) | 40 parts |
| Polyester resin (RS-801 having an acid value of 10, Mw of 20,000 and Tg of 64° C., manufactured by Sanyo Chemical Industries Ltd.) | 60 parts |
| Water | 30 parts |

The compound was kneaded for 45 minutes at 130° C. by a two-roll mill and crushed by a pulverizer to prepare a masterbatch (1) having a particle diameter of 1 mm.

Preparation of Material Solution (1)

The following components were placed in a reacting container having a stirrer and a thermometer.

| | |
|---|---|
| The low molecular weight polyester (1) | 378 parts |
| Carnauba wax | 110 parts |
| Charge controller (salicylic metal complex E-84, manufactured by Orient Chemical Industries Ltd.) | 22 parts |
| Ethyl acetate | 947 parts |

The mixture was heated to 80° C. with agitating. After the mixture was stirred at 80° C. for 5 hours, followed by cooling to 30° C. in an hour. Next, 500 parts of the masterbatch (1) and 500 parts of ethyl acetate were added thereto and the mixture was mixed for 1 hour to prepare a material solution (1).

Preparation of Pigment/Wax Dispersion (1)

The material solution (1) of 1,324 parts was transferred to a container and dispersed by a bead mill (ULTRA VISCO MILL, manufactured by Aimex Co., Ltd.) under the following condition.

Liquid sending speed: 1 kg/hour

Disc rotating speed: 6 m/second

Beads: zirconia beads having a size of 0.5 mm were contained in the mill at a volume of 80%

Number of times of dispersion: 3 passes

Next, 65% aqueous solution of ethyl acetate of the low molecular weight polyester (1) was added thereto and the mixture was passed once through the bead mill under the above-mentioned conditions to prepare a pigment/wax dispersion (1). The solid content of the pigment/wax dispersion (1) was 50% when measured by heating the dispersion at 130° C. for 30 minutes.

Preparation of Emulsion Slurry (1)

The following components were placed in a container.

| | |
|---|---|
| Pigment/wax dispersion (1) | 648 parts |
| Prepolymer (1) | 154 parts |
| Ketimine compound (1) | 6.6 parts |

Then the components were mixed by TK HOMO MIXER (manufactured by Tokushu Kika Kogyo Co., Ltd.) at a revolution of 5,000 rpm for 1 minute. Then 1,200 parts of the water phase (1) was added thereto to be mixed by TK HOMO MIXER at a revolution of 13,000 rpm for 20 minutes to prepare an emulsion slurry (1).

Preparation of Dispersing Slurry (1)

The emulsion slurry (1) was placed in a container having a stirrer and a thermometer to be subjected to a solvent removing treatment at 30° C. for 8 hours, followed by aging at 45° C. for 4 hours to prepare a dispersion slurry (1).

Preparation of Filtered Cake (1)

The dispersion slurry (1) of 100 parts was filtered under reduced pressure. Then the following steps were taken to prepare a filter cake (1).

1) 100 parts of ion-exchanged water was added to the filtered dispersion slurry to be mixed by TK HOMO MIXER (at a revolution of 12,000 rpm for 10 minutes) followed by filtering to prepare a filtered cake (a).
2) 100 parts of 10% aqueous solution of sodium hydroxide was added to the filtered cake (a) to be mixed by the TK HOMO MIXER (at a revolution of 12,000 rpm for 30 minutes) with an ultrasonic vibration, followed by filtering under reduced pressure. This ultrasonic alkali washing was repeated twice to prepare a filtered cake (b).
3) 100 parts of 10% aqueous solution of hydrochloric acid was added to the filter cake (b) to be mixed by the TK HOMO MIXER (at a revolution of 12,000 rpm for 10 minutes) followed by filtering to prepare a filtered cake (c).
4) 300 parts of ion-exchanged water was added to the filtered cake (c) to be mixed by the TK HOMO MIXER (at a revolution of 12,000 rpm for 10 minutes) followed by filtering twice to prepare a filtered cake (1).

Preparation of Mother Toner (1)

The filter cake (1) was dried by an air dryer at 45° C. for 48 hours and sifted with a mesh having 75 μm openings to prepare a mother toner (1). Then 100 parts of the mother toner (1) was mixed with 0.5 parts of hydrophobic silica and 0.5 parts of hydrophobic titanium oxide by a Henshel mixer to prepare a toner A of the present invention.

Preparation of Carrier (1)

Two parts of polyvinyl alcohol, 60 parts of water, and 100 parts of magnetite prepared by a wet method were placed in a ball mill to be mixed for 12 hours to prepare a slurry of the magnetite. The slurry was sprayed by a spray dryer to prepare particles having an average particle diameter of 54 μm.

The particle were baked at 1,000° C. for 3 hours in a nitrogen environment, followed by cooling to prepare a carrier (1)

Preparation of Cover Layer Forming Liquid (1)

The following components were dispersed with HOMO MIXER for 20 minutes to prepare a cover layer forming liquid (1).

| | |
|---|---|
| Silicone resin solution | 100 parts |
| Toluene | 100 parts |
| γ-aminopropyltrimethoxysilane | 6 parts |
| Carbon black | 10 parts |

The cover layer forming liquid (1) is coated with a fluidized bed type coating apparatus on the surface of 1,000 parts of the carrier (1) to prepare a silicone resin coated carrier.

In addition, the silicone resin coated carrier was mixed with the above prepared toner A at the toner concentration of 4.0% to prepare a two-component developer.

Comparative Example 1

A developing sleeve having grooves on the surface thereof at an interval of 0.65 mm and the two-component developer in Example 1 were used for evaluation.

Example 2 and Comparative Examples 2 to 5

The procedure for preparation of the toner A was repeated except for the following:

1) the volume average particle diameter of the mother toner was changed as shown in Table 1 by changing an addition quantity of the fine particle dispersion when the water phase was prepared; and
2) the volume average particle diameter of the toner and a content of fine powders having a circle equivalent particle diameter not greater than 2 μm were changed as shown in Table 1 by classifying the mother toner using an air classifier. Thus toners B, G, H, I and J were prepared. In addition, the procedure for preparation of the developer in Example 1 was repeated.

Examples 3 to 5

The dispersion diameter of the wax in the toner can be controlled by changing agitating condition of the components when the oil phase was prepared. The wax concentration in the surface portion and outer portion can be controlled by changing the aging temperature and time in the emulsifying process.

Accordingly, by appropriately changing the above-mentioned conditions, toners C, D and E having different wax concentration in the surface portion (from 0 to 1 μm) and the outer portion thereof were prepared. In addition, the procedure for preparation of the carrier in Example 1 was repeated.

Example 6

The procedure for preparation of the toner and the two-component developer in Example 1 were repeated except that the ester wax was replaced with a carnauba wax subjected to a treatment of removing a free aliphatic fatty acid. Thus a toner F, and a developer including the toner F were prepared.

The physical properties of the above-prepared toners are shown in Table 1.

TABLE 1

| | Volume average particle diameter (μm) | Content of fine particles having a diameter not greater than 2 μm (% by number) | Wax area in the surface portion of the toner having a depth of from 0 to 1 μm (%) | Wax existing in the outer portion of the toner (% by number) | Content of wax particles having dispersion diameter of from 0.5 to 3.0 μm (% by number) |
|---|---|---|---|---|---|
| Ex. 1 (Toner A) | 5.5 | 13.0 | 35 | 60 | 50 |
| Ex. 2 (Toner B) | 5.5 | 19.5 | 33 | 55 | 45 |
| Ex. 3 (Toner C) | 5.5 | 19.0 | 25 | 50 | 68 |
| Ex. 4 (Toner D) | 5.5 | 19.0 | 22 | 68 | 58 |
| Ex. 5 (Toner E) | 5.5 | 19.0 | 35 | 75 | 75 |
| Ex. 6 (Toner F) | 5.5 | 19.0 | 25 | 80 | 95 |
| Comp. Ex. 1 (Toner G) | 3.0 | 28.5 | 30 | 87 | 72 |
| Comp. Ex. 2 (Toner H) | 8.0 | 13.5 | 30 | 87 | 80 |
| Comp. Ex. 3 (Toner I) | 6.0 | 23.0 | 65 | 77 | 40 |
| Comp. Ex. 4 (Toner J) | 7.5 | 45.0 | 40 | 90 | 55 |

Evaluation Items

Each of the developers of Examples 1 to 6 and Comparative Examples 2 to 5 was sent in a modified copier IMAGIO MF7070 (manufactured by RICOH Co., Ltd.) to be evaluated in the respect to the following items. This developing apparatus is explained above. The highest value of the magnetic flux density of the main magnetic pole P1*b* in a normal line direction is 120 mT and the attenuation ratio thereof is 53.5%, a half width of the main magnetic pole P1*b* is 16°, and the auxiliary magnets are arranged at an angle of 25°. The developing sleeve has grooves on an outer surface thereof which is formed in a longitudinal direction thereof at an interval of 0.5 mm with a depth of 0.2 mm.

(Image Density)

A 100,000-copy running test was performed. A black solid image of A3 size were printed continuously on 4 paper sheets after the first sheet, 20,000$^{th}$ sheet and 100,000$^{th}$ sheet. The image density of a rear portion of the fourth sheet was measured by a Macbeth densitometer.

(Toner Mal-distribution Deposited at Rear Part of Receiving Sheet)

A 50% halftone dot image was produced. The image densities of a center and an edge of the image portion apart from the tip edge by 15 mm were measured to determine the difference between the densities. The images are ranked as follows.

○: The difference is not greater than 0.10.

Δ: The difference is from 0.11 to 0.20.

×: The difference is greater than 0.20.

The measurements were performed by the Macbeth densitometer with respect to an image portion having a diameter of 5 mm.

(White Stripe in Halftone Image)

After printing 100,000 copies having image occupation of 6%, an image having halftone of 1 dot×1 dot was printed to determine whether a white stripe is present in the halftone image. The images are ranked as follows.

○: White stripe is not observed.

Δ: White stripe is formed but the image quality is still acceptable.

×: White stripe is formed and the image quality is not acceptable.

(Image Density)

A black solid image of A3 size were continuously printed on 4 paper sheets after printing 100,000 copies. The image density of a rear portion of the fourth sheet was measured by a Macbeth densitometer.

(Reproducibility of Thin Lines)

Thin line images in which 2.0, 2.2, 2.5, 2.8, 3.2, 3.6, 4.0, 4.5, 5.0, 5.6, 6.3 and 7.1 lines are formed vertically and horizontally at an equal interval per 1 mm were printed. The resultant images were visually observed to determine whether the images could reproduce the lines. The images are ranked as follows.

◎: The lines of 6.3 to 7.1 lines/mm can be reproduced.

○: The lines of 5.0 to 5.6 lines/mm can be reproduced.

□: The lines of 4.0 to 4.5 lines/mm can be reproduced.

Δ: The lines of 2.8 to 3.6 lines/mm can be reproduced.

×: The lines of 2.0 to 2.5 lines/mm can be reproduced.

TABLE 2

| | Interval of grooves of the surface of developing sleeve (mm) | Image Density Initial | After 20,000 copies | After 100,000 copies | Toner maldistribution deposited at rear part of receiving sheet | White stripe on half-tone image | Reproducibility of thin lines |
|---|---|---|---|---|---|---|---|
| Example 1 | 0.5 | 1.44 | 1.40 | 1.35 | ○ | Δ | ○ |
| Example 2 | 0.5 | 1.44 | 1.41 | 1.29 | ○ | ○ | ◎ |
| Example 3 | 0.5 | 1.42 | 1.39 | 1.35 | ○ | ○ | ◎ |
| Example 4 | 0.5 | 1.44 | 1.42 | 1.39 | ○ | ○ | ◎ |
| Example 5 | 0.5 | 1.43 | 1.43 | 1.40 | ○ | ○ | ◎ |
| Example 6 | 0.5 | 1.43 | 1.44 | 1.44 | ○ | ○ | ◎ |
| Comparative Example 1 | 0.65 | 1.42 | 1.42 | 1.40 | X | ○ | Δ |
| Comparative Example 2 | 0.5 | 1.35 | 1.10 | 0.81 | ○ | X | ○ |
| Comparative Example 3 | 0.5 | 1.44 | 1.40 | 1.42 | ○ | Δ | X |
| Comparative Example 4 | 0.5 | 1.44 | 1.03 | 0.75 | ○ | X | ○ |
| Comparative Example 5 | 0.5 | 1.43 | 1.29 | 0.65 | ○ | X | ○ |

This document claims priority and contains subject matter related to Japanese Patent Application No. 2002-275550 filed on Sep. 20th, 2002, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member configured to bear an electrostatic latent image thereon;

a developing sleeve comprising:

a nonmagnetic sleeve having grooves with a depth of from 0.1 to 0.2 mm on an outer surface thereof in a longitudinal direction thereof at an interval of from 0.4 to 0.6 mm; and a magnet roller fixedly set in the nonmagnetic sleeve, wherein the developing sleeve magnetically bears thereon a magnetic two component developer comprising a toner and a carrier while rotating to form a magnet brush thereon, wherein the developing sleeve rubs the image bearing member with the magnet brush to visualize the electrostatic latent image at a rubbing region, wherein the magnet roller comprises a main magnet pole, which faces the latent image bearing member and which comprises a main magnet and auxiliary magnets adjacent to the main magnet, wherein the main magnet has a magnetic flux density in a normal line direction of from 100 to 200 mT at the rubbing region, an attenuation ratio of the magnetic flux not less than 40% and a half width not greater than 25°, and each of the auxiliary magnets has an attenuation ratio of a magnetic flux density in a normal line direction not less than 40%, and is arranged at an angle not greater than 35° from the main magnet, and wherein the toner has a volume average particle diameter of from 4.0 to 7.0 μm, and includes fine particles having a circle equivalent diameter not greater than 2 μm in an amount not greater than 20% by number.

2. The image forming apparatus according to claim 1, wherein the toner comprises at least a wax and a binder resin, and wherein when a cross section of particles of the toner was observed with a transmission electron microscope, a surface portion of the particles of the toner, which surface portion has a depth of from 0 to 1 μm, has a wax area of from 5 to 30%.

3. The image forming apparatus according to claim 2, wherein the wax exists in an outer portion of the particles of the toner, which outer portion has a depth of from 0 to half a radius of the particles, in an amount not less than 65% by number of the wax dispersed in the entire toner.

4. The image forming apparatus according to claim 3, wherein the wax dispersed in the toner does not appear on a surface of the toner.

5. The image forming apparatus according to claim 2, wherein particles of the wax having a dispersion diameter of from 0.5 to 3 μm are present in the particles of the toner in an amount not less than 70% by number based on total wax particles in the particles of the toner.

6. The image forming apparatus according to claim 2, wherein the wax is selected from carnauba waxes subjected to a treatment of removing a free aliphatic fatty acid, rice waxes, montan waxes and combinations thereof.

7. A method for developing an electrostatic latent image, comprising:

forming a magnet brush of a magnetic developer comprising a toner and a carrier on a developing sleeve comprising a nonmagnetic sleeve and a magnet roller located in the nonmagnetic sleeve; and rubbing a surface of an image bearing member bearing the electrostatic latent image thereon with the magnet brush to from a toner image on the image bearing member, wherein the magnet roller comprises a main magnet pole, which faces the latent image bearing member and which comprises a main magnet and auxiliary magnets adjacent to the main magnet, wherein the main magnet has a magnetic flux density in a normal line direction of from 100 to 200 mT at the rubbing region, an attenuation ratio of the magnetic flux not less than 40% and a half width not greater than 25°, and each of the auxiliary magnets has an attenuation ratio of a magnetic flux density in a normal line direction not less than 40%, and is arranged at an angle not greater than 35° from the main magnet, wherein the nonmagnetic sleeve has grooves with a depth of from 0.1 to 0.2 mm on an outer surface thereof in a longitudinal direction thereof at an interval of from 0.4 to 0.6 mm, and wherein the toner has a volume average particle diameter of from 4.0 to 7.0 μm, and includes fine particles having a circle equivalent diameter not greater than 2 μm in an amount not greater than 20% by number.

8. The image forming method according to claim 7, wherein the toner comprises at least a wax and a binder resin, and wherein when a cross section of particles of the toner was observed with a transmission electron microscope, a surface portion of the particles of the toner having a depth of from 0 to 1 μm has a wax area of from 5 to 30%.

9. The image forming method according to claim 8, wherein the wax exists in an outer portion of the particles of the toner, which outer portion has a depth of from 0 to half a radius of the particles, in an amount not less than 65% by number of the wax dispersed in the entire toner.

10. The image forming method according to claim 9, wherein the wax dispersed in the toner does not appear on a surface of the toner.

11. The image forming method according to claim 8, wherein particles of the wax having a dispersion diameter of from 0.5 to 3 μm are present in the particles of the toner in an amount not less than 70% by number based on total wax particles in the toner.

12. The image forming method according to claim 8, wherein the wax is selected from carnauba waxes subjected to a treatment of removing a free aliphatic fatty acid, rice waxes, montan waxes and combinations thereof.

13. A process cartridge for an image forming apparatus, comprising:

an image bearing member configured to bear an electrostatic latent image thereon; and a developing device configured to develop the electrostatic latent image with a developer comprising a toner to form a toner image on the image bearing member, wherein the developing device comprises:

a developing sleeve comprising:

a nonmagnetic sleeve having grooves with a depth of from 0.1 to 0.2 mm on an outer surface thereof in a longitudinal direction thereof at an interval of from 0.4 to 0.6 mm; and a magnet roller fixedly set in the nonmagnetic sleeve, wherein the developing sleeve magnetically bears thereon a magnetic two component developer comprising a toner and a carrier while rotating to form a magnet brush thereon, wherein the developing sleeve rubs the image bearing member with the magnet brush to visualize the electrostatic latent image at a rubbing region, wherein the magnet roller comprises a main magnet pole, which faces the latent image bearing member and which comprises a main magnet and auxiliary magnets adjacent to the main magnet, wherein the main magnet has a magnetic flux density in a normal line direction of from 100 to 200 mT at the rubbing region, an attenuation ratio of the magnetic flux not less than 40% and a half width not greater than 25°, and each of the auxiliary magnets has an attenuation ratio of a magnetic flux density in a normal line direction not less than 40%, and is arranged at an angle not greater than 35° from the main magnet, and wherein the toner has a volume average particle diameter of from 4.0 to 7.0 μm, and includes fine particles having a circle equivalent diameter not greater than 2 μm in an amount not greater than 20% by number.

14. The process cartridge according to claim 13, wherein the toner comprises at least a wax and a binder resin, and wherein when a cross section of particles of the toner was observed with a transmission electron microscope, a surface portion of the particles of the toner, which surface portion has a depth of from 0 to 1 μm, has a wax area of from 5 to 30%.

15. The process cartridge according to claim 14, wherein the wax exists in an outer portion of the particles of the toner, which outer portion has a depth of from 0 to half a radius of the particles, in an amount not less than 65% by number of the wax dispersed in the entire toner.

16. The process cartridge according to claim 15, wherein the wax dispersed in the toner does not appear on a surface of the toner.

17. The process cartridge according to claim 14, wherein particles of the wax having a dispersion diameter of from 0.5 to 3 μm are present in the particles of the toner in an amount not less than 70% by number based on total wax particles in the particles of the toner.

18. The process cartridge according to claim 14, wherein the wax is selected from carnauba waxes subjected to a treatment of removing a free aliphatic fatty acid, rice waxes, montan waxes and combinations thereof.

* * * * *